US007404428B2

(12) United States Patent
Sun et al.

(10) Patent No.: US 7,404,428 B2
(45) Date of Patent: Jul. 29, 2008

(54) FOLDABLE HONEYCOMB STRUCTURE AND METHOD FOR MAKING THE SAME

(75) Inventors: Yi-Wei Sun, Kaohsiung (TW); Chin-Yuan Lu, Kaohsiung County (TW); Li-Ming Cheng, Kaohsiung County (TW); Kuei-Lin Tsai, Kaohsiung County (TW)

(73) Assignees: Metal Industries Research & Development Centre, Kaohsiung (TW); King Koon Industrial Corp., Kaohsiung (TW)

( * ) Notice: Subject to any disclaimer, the term of this patent is extended or adjusted under 35 U.S.C. 154(b) by 278 days.

(21) Appl. No.: 11/235,146

(22) Filed: Sep. 27, 2005

(65) Prior Publication Data

US 2007/0039697 A1 Feb. 22, 2007

(30) Foreign Application Priority Data

Aug. 17, 2005 (TW) ..... 94128062 A

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |

(52) U.S. Cl. ..... 160/84.05; 156/197; 156/227; 156/291; 156/292

(58) Field of Classification Search ..... 160/115, 160/84.01, 84.04, 84.05; 428/116, 118; 156/196, 197, 227, 290, 291, 292, 89.22
See application file for complete search history.

(56) References Cited

U.S. PATENT DOCUMENTS 3,164,507 A 1/1965 Masuda
4,019,554 A 4/1977 Rasmussen
4,307,768 A 12/1981 Anderson
4,346,132 A 8/1982 Cheng et al.
4,347,887 A 9/1982 Brown
4,388,354 A 6/1983 Suominen
4,450,027 A 5/1984 Colson
4,500,380 A 2/1985 Bova
4,603,072 A 7/1986 Colson
4,631,108 A 12/1986 Colson
4,631,217 A 12/1986 Anderson
4,647,488 A 3/1987 Schnebly et al.
4,673,600 A 6/1987 Anderson
4,675,060 A 6/1987 Schnebly et al.
4,676,855 A 6/1987 Anderson
4,677,012 A 6/1987 Anderson
4,677,013 A 6/1987 Anderson (Continued)

*Primary Examiner*—Katherine Mitchell
*Assistant Examiner*—Jeremy C Ramsey
(74) *Attorney, Agent, or Firm*—Volentine & Whitt, PLLC

(57) ABSTRACT

The present invention relates to a foldable honeycomb structure and method for making the same. The method comprises (a) providing a plurality of flat strips; (b) forming a pair of longitudinal creases in each strip thereby defining the first two longitudinal margins of each strip and a central portion of each strip between the creases; (c) folding each strip along said creases so that each folded strip has two exposed outside surfaces; (d) applying at least three longitudinal glue lines to the exposed outside surface of each folded strip; and (e) stacking the glued strips. As a result, it need not open the longitudinal margins during the process of applying the longitudinal glue lines, which can avoid the deformation of the strip and have a precise gluing position.

35 Claims, 25 Drawing Sheets

U.S. PATENT DOCUMENTS 4,685,986 A 8/1987 Anderson
4,732,630 A 3/1988 Schnebly
4,795,515 A 1/1989 Kao et al.
4,849,039 A 7/1989 Colson et al.
4,861,404 A 8/1989 Neff
4,871,006 A 10/1989 Kao et al.
4,885,190 A 12/1989 Schnebly
4,943,454 A 7/1990 Neff
4,984,617 A 1/1991 Corey
4,999,073 A 3/1991 Kao et al.
5,002,628 A 3/1991 Schnebly
5,015,317 A 5/1991 Corey et al.
5,043,039 A 8/1991 Swiszcz
5,104,469 A 4/1992 Colson
5,106,444 A 4/1992 Corey et al.
5,135,461 A 8/1992 Corey et al.
5,151,151 A 9/1992 Kao et al.
5,160,563 A 11/1992 Kutchmarek et al.
5,193,601 A 3/1993 Corey et al.
5,205,891 A 4/1993 Neff
5,228,936 A 7/1993 Goodhue
5,334,276 A 8/1994 Meier
5,390,720 A 2/1995 Colson et al.
5,405,483 A 4/1995 Neff
5,441,592 A 8/1995 Ruggles et al.
5,482,750 A * 1/1996 Colson et al. ..... 428/12
5,525,395 A 6/1996 Huang
5,547,006 A 8/1996 Auger
5,560,976 A 10/1996 Huang
5,601,885 A * 2/1997 Akins ..... 428/12
5,620,035 A 4/1997 Judkins
5,630,898 A 5/1997 Judkins
5,630,900 A 5/1997 Huang
5,654,073 A 8/1997 Swiszcz et al.
5,670,000 A 9/1997 Colson et al.
5,680,891 A 10/1997 Prince
5,690,778 A 11/1997 Swiszcz et al.
5,691,031 A 11/1997 Swiszcz et al.
5,692,550 A 12/1997 Ford et al.
5,701,940 A 12/1997 Ford et al.
5,702,552 A 12/1997 Kutchmarek et al.
5,714,034 A 2/1998 Goodhue
5,733,632 A 3/1998 Marusak
5,813,447 A 9/1998 Lysyj
5,834,090 A 11/1998 Huang
5,837,084 A 11/1998 Barss
5,888,639 A 3/1999 Green et al.
5,918,655 A 7/1999 Corey
5,974,763 A 11/1999 Colson et al.
6,019,864 A 2/2000 Jones
6,045,890 A 4/2000 Green et al.
6,052,966 A 4/2000 Colson et al.
6,066,382 A 5/2000 Swiszcz et al.
6,103,336 A 8/2000 Swiszcz
6,206,075 B1 3/2001 Prince et al.
6,284,347 B1 9/2001 Green et al.
6,319,586 B1 11/2001 Colson
6,345,486 B1 2/2002 Colson et al.
6,416,842 B1 7/2002 Swiszcz et al.
6,461,464 B1 10/2002 Swiszcz
6,491,084 B2 * 12/2002 Voss et al. ..... 160/84.05
6,513,565 B1 2/2003 Rupel et al.
6,527,895 B1 3/2003 Palmer
6,572,725 B2 6/2003 Goodhue
6,672,186 B2 1/2004 Corey
6,740,389 B2 5/2004 Yu
6,767,615 B1 7/2004 Judkins et al.
6,817,400 B2 11/2004 Corey et al.
6,854,501 B2 2/2005 Corey
2006/0196615 A1 * 9/2006 Yu et al. ..... 160/178.1 R

* cited by examiner

FOLDABLE HONEYCOMB STRUCTURE AND METHOD FOR MAKING THE SAME

BACKGROUND OF THE INVENTION

1. Field of the Invention

The present invention relates to a foldable honeycomb structure and the method for making the same, and particularly relates to a foldable honeycomb structure made through a simple process and the method for making the same.

2. Description of the Related Art

Referring to FIG. 1, a schematic sectional view of a first kind of conventional foldable honeycomb structure is shown. The conventional foldable honeycomb structure 1 is applied to thermal insulation devices such as window curtain, and can be texture or non-texture, as shown in FIG. 2. Referring to FIG. 1, the honeycomb structure 1 is a double cell row structure, in which the reference numbers 11*a*, 11*b*, 11*c*, 12*a*, 12*b* and the like refer to a cell, the cells 11*a*, 11*b*, 11*c* refer to a first row, and the cells 12*a*, 12*b* refer to a second row.

Referring to FIGS. 3*a* to 3*d*, schematic views of a method for making the conventional foldable honeycomb structure in FIG. 1 are shown. First, a flat strip 13 with a length extending longitudinally is provided as shown in FIG. 3*a*. The strip 13 has a first surface 131 and a second surface 132.

Next, referring to FIG. 3*b*, a first longitudinal crease 14 and a second longitudinal crease 15 are formed on the strip 13, so as to define a first longitudinal margin 16, a central portion 17 and a second longitudinal margin 18 on the strip 13. Then, the first longitudinal margin 16 of the strip 13 is folded towards one side (upside) of the strip 13 along the first longitudinal crease 14, and the second longitudinal margin 18 of the strip 13 is folded towards the other side (underside) of the strip 13 along the second longitudinal crease 15, thereby forming an approximate Z-shape appearance. The first longitudinal margin 16 has a first surface 161 and a second surface 162; the central portion 17 has a first surface 171 and a second surface 172; and the second longitudinal margin 18 has a first surface 181 and a second surface 182, wherein the first surfaces 161, 171, 181 are the same as the first surface 131 of the strip 13, and the second surfaces 162, 172, 182 are the same as the second surface 132 of the strip 13.

Next, referring to FIG. 3*c*, a first glue line 191, a second glue line 192 and a third glue line 193 are applied longitudinally to the folded strip 13. The first glue line 191 is applied on the inside surface where the first longitudinal margin 16 and the central portion 17 are overlapped, i.e. between the first surface 161 of the first longitudinal margin 16 and the first surface 171 of the central portion 17, and the first glue line 191 is at the free end of the first longitudinal margin 16. The second glue line 192 is applied to the second surface 172 of the central portion 17 at the position where the central portion 17 and the second longitudinal margin 18 are not overlapped, and the second glue line 192 is usually at the position corresponding to half of the width of the first longitudinal margin 16. The third glue line 193 is applied to the first surface 181 of the second longitudinal margin 18, and is at the free end of the second longitudinal margin 18.

Next, referring to FIG. 3*d*, the glued strips 13 are stacked; the first glue line 191 is used for adhering the free end of the first longitudinal margin 16 to the central portion 17; the second glue line 192 is used for adhering the central portion 17 to a first longitudinal margin of another adjacent (underlying) strip; and the third glue line 193 is used for adhering the second longitudinal margin 18 to a central portion of another adjacent (underlying) strip. The expanded view after adhering is as shown in FIG. 1.

Referring to FIG. 4, a schematic sectional view of a second kind of conventional foldable honeycomb structure is shown. The conventional foldable honeycomb structure 2 is a four-cell row structure.

Referring to FIGS. 5*a* to 5*d*, schematic views of a method for making the conventional foldable honeycomb structure in FIG. 4 is shown. First, referring to FIG. 5*a*, a flat strip 23 with a length extending longitudinally is provided. The strip 23 has a first surface 231 and a second surface 232.

Then, referring to FIG. 5*b*, a first longitudinal crease 24 and a second longitudinal crease 25 are formed on the strip 23, so as to define a first longitudinal margin 26, a central portion 27 and a second longitudinal margin 28 on the strip 23. After that, the first longitudinal margin 26 of the strip 23 is folded towards one side (upside) of the strip 23 along the first longitudinal crease 24, and the second longitudinal margin 28 of the strip 23 is folded towards the other side (underside) of the strip 23 along the second longitudinal crease 25, thereby forming an approximate Z-shape appearance. The first longitudinal margin 26 has a first surface 261 and a second surface 262, the central portion 27 has a first surface 271 and a second surface 272, and the second longitudinal margin 28 has a first surface 281 and a second surface 282, wherein the first surfaces 261, 271, 281 are the same as the first surface 231 of the strip 23, and the second surfaces 262, 272, 282 are the same as the second surface 232 of the strip 23.

Then, Referring to FIG. 5*c*, a first glue line 291, a second glue line 292, a third glue line 293, a fourth glue line 294 and a fifth glue line 295 are applied longitudinally to the folded strip 23. The first glue line 291 is applied to the inside surface where the first longitudinal margin 26 and the central portion 27 are overlapped, i.e. between the first surface 261 of the first longitudinal margin 26 and the first surface 271 of the central portion 27, and the first glue line 291 is at the location corresponding to the free end of the first longitudinal margin 26. The second glue line 292 is applied to the second surface 272 of the central portion 27 at the location where the central portion 27 and the second longitudinal margin 28 are not overlapped, and the second glue line 292 is usually at the location corresponding to half of the width of the first longitudinal margin 26. The third glue line 293 is applied to the first surface 281 of the second longitudinal margin 28, and is at the free end of the second longitudinal margin 28. The fourth glue line 294 is applied to the inside surface where the second longitudinal margin 28 and the central portion 27 are overlapped, i.e. between the second surface 282 of the second longitudinal margin 28 and the second surface 272 of the central portion 27, and the fourth glue line 294 is two thirds of the width of the second longitudinal margin 28 away from the second longitudinal crease 25. The fifth glue line 295 is applied to the first surface 281 of the second longitudinal margin 28, and is one third of the width of the second longitudinal margin 28 away from the second longitudinal crease 25.

Next, referring to FIG. 5*d*, the glued strips 23 are stacked, wherein the first glue line 291 is used for adhering the free end of the first longitudinal margin 26 to the central portion 27. The second glue line 292 is used for adhering the central portion 27 to a first longitudinal margin of another adjacent (underlying) strip. The third glue line 293 is used for adhering the second longitudinal margin 28 to a central portion of another adjacent (underlying) strip. The fourth glue line 294 is used for adhering the second longitudinal margin 28 to the central portion 27. The fifth glue line 295 is used for adhering the second longitudinal margin 28 to a central portion of another adjacent (underlying) strip. The expanded view after adhering is as shown in FIG. 4.

The first kind of conventional double cell row honeycomb structure 1 of FIG. 1 and the second kind of conventional four cell row honeycomb structure 2 of FIG. 4 and other methods of making the same have been disclosed in U.S. Pat. Nos. 5,482,750, 5,670,000, 5,702,552, 6,319,586. The most important problem of the honeycomb structure and method for making the same described above resides in that the glue lines are between the central portions and the longitudinal margins. Taking the double cell row honeycomb structure 1 of FIG. 3*c* for example, the first glue line 191 is applied to the inside surface where the first longitudinal margin 16 and the central portion 17 are overlapped. During practical production process, since the first longitudinal margin 16, the central portion 17 and the second longitudinal margin 18 are very close when the strip 13 is folded as an approximate Z-shape as shown in FIG. 3*b*. Therefore, when the first glue line 191 is to be applied, a strip opener is required to be interposed between the first longitudinal margin 16 and the central portion 17 to open the first longitudinal margin 16, such that the gluing nozzle can go deep into the gap between the first longitudinal margin 16 and the central portion 17 to apply the first glue line 191. In this way, the strip 13 will be subjected to a force, which results in the bending deformation of the central portion 17, and thus the precision of gluing position is affected, as well as the aesthetic appearance of the final products.

Similarly, taking the four cell row honeycomb structure 2 of FIG. 5*c* for example, the first glue line 291 is applied to the inside surface where the first longitudinal margin 26 and the central portion 27 are overlapped, and the fourth glue line 294 is applied to the inside surface where the second longitudinal margin 28 and the central portion 27 are overlapped. The above-mentioned problem of requiring a strip opener is not yet eliminated.

Furthermore, another problem of the above honeycomb structure and method for making the same resides in that it employs the same strip, and if a manufactured honeycomb structure is desired to have two sides of different colors, the difficulty in dyeing will be increased; or if a manufactured honeycomb structure is desired to have two sides with different material properties, it is very difficult to manufacture the strip.

Consequently, there is an existing need for a foldable honeycomb structure and method for making the same to solve the above-mentioned problems.

SUMMARY OF THE INVENTION

The main object of the present invention is to provide a method for making a foldable honeycomb structure, wherein the gluing positions are on at least one of exposed outside surfaces. As a result, it need not open the longitudinal margins during the process of applying the longitudinal glue lines, which can avoid the deformation of the strip and have a precise gluing position. Moreover, since the conventional trip opener is omitted, the manufacture equipment can be more simplified, thus reducing the cost and the process time.

Another object of the present invention is to provide a method for making a foldable honeycomb structure, wherein two strips of different materials, colors or made through different processes are used to improve the combined functionality.

In order to achieve the above objects, the present invention provides a method for making a foldable honeycomb structure, which comprises the steps of:

(a) providing a plurality of flat strips each of which has a length extending longitudinally;

(b) forming a first longitudinal crease and a second longitudinal crease on each strip, so as to define a first longitudinal margin, a central portion and a second longitudinal margin on each strip;

(c) folding the first longitudinal margin of each strip towards one side of the strip along the first longitudinal crease, and folding the second longitudinal margin of each strip towards the other side of each strip along the second longitudinal crease, so that each folded strip has a first exposed outside surface and a second exposed outside surface opposite to the first exposed outside surface;

(d) applying a first glue line, a second glue line and a third glue line longitudinally on the first exposed outside surface or the second exposed outside surface of each folded strip; and (e) stacking the glued strips, wherein the first glue line is used for adhering a central portion of a strip to a second longitudinal margin of an adjacent strip; the second glue line is used for adhering a first longitudinal margin of a strip to a second longitudinal margin of an adjacent strip; and the third glue line is used for adhering a first longitudinal margin of a strip to a central portion of an adjacent strip.

DETAILED DESCRIPTION OF THE INVENTION

Figure 1:
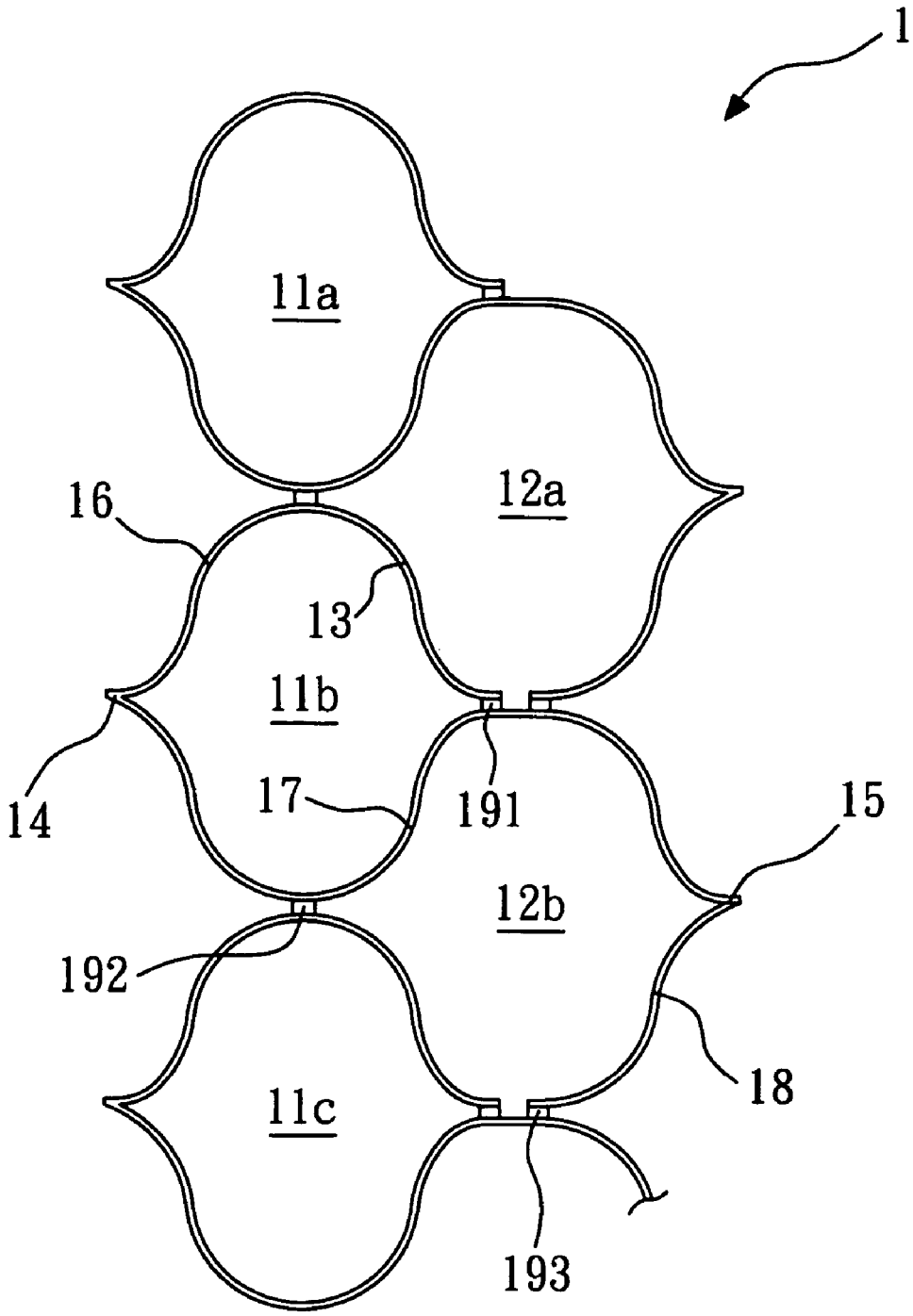
FIG. 1 (Prior Art)
FIG. 1 shows a schematic sectional view of a first kind of conventional foldable honeycomb structure.
Figure 2:
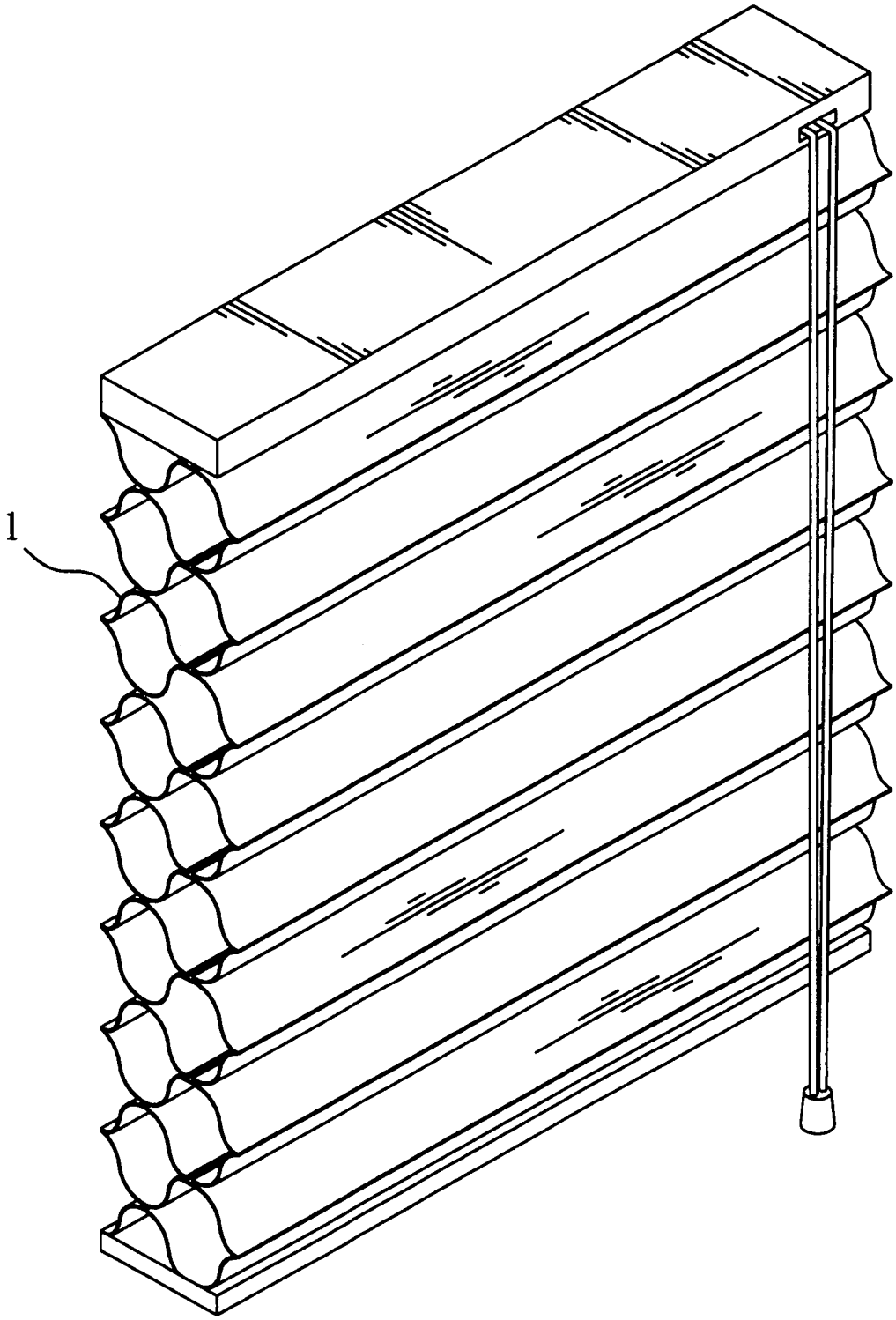
FIG. 2 (Prior Art)
FIG. 2 shows a schematic view of the conventional foldable honeycomb structure of FIG. 1 applied to the window curtain.
Figure 3A:
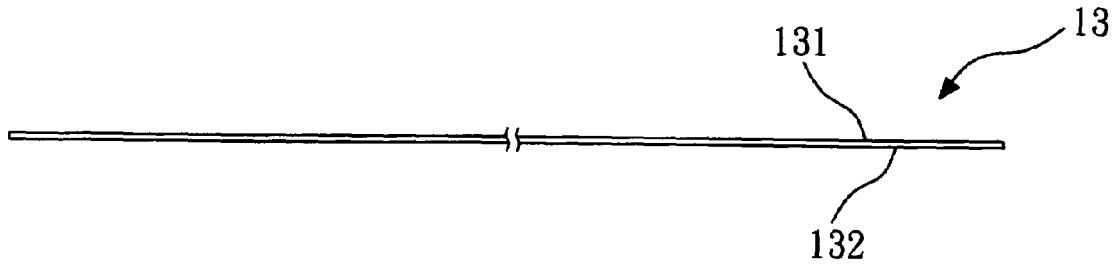
FIG. 3a (Prior Art)
FIGS. 3*a*-3*d* show schematic views of a method for making the conventional foldable honeycomb structure of FIG. 1.
Figure 3B:
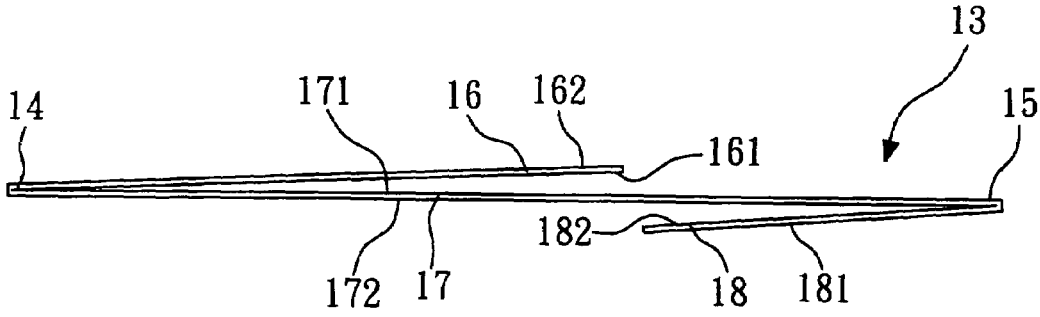
FIG. 3b (Prior Art)
Figure 3C:
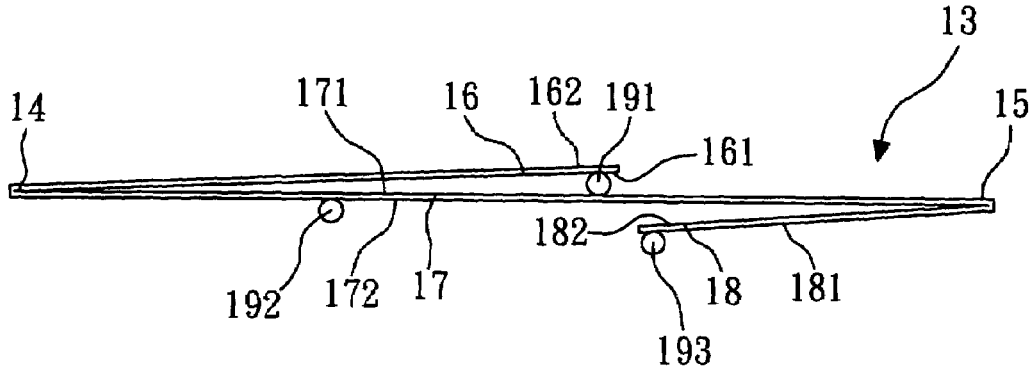
FIG. 3c (Prior Art)
Figure 3D:
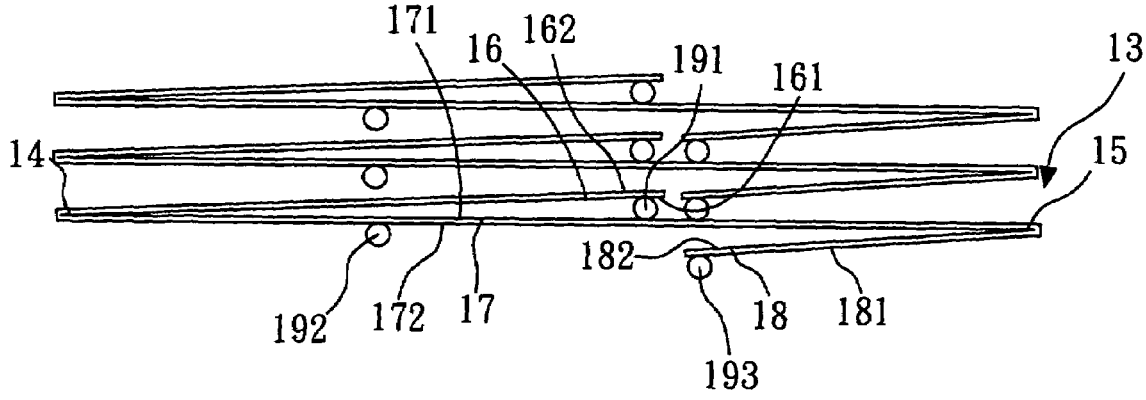
FIG. 3d (Prior Art)
Figure 4:
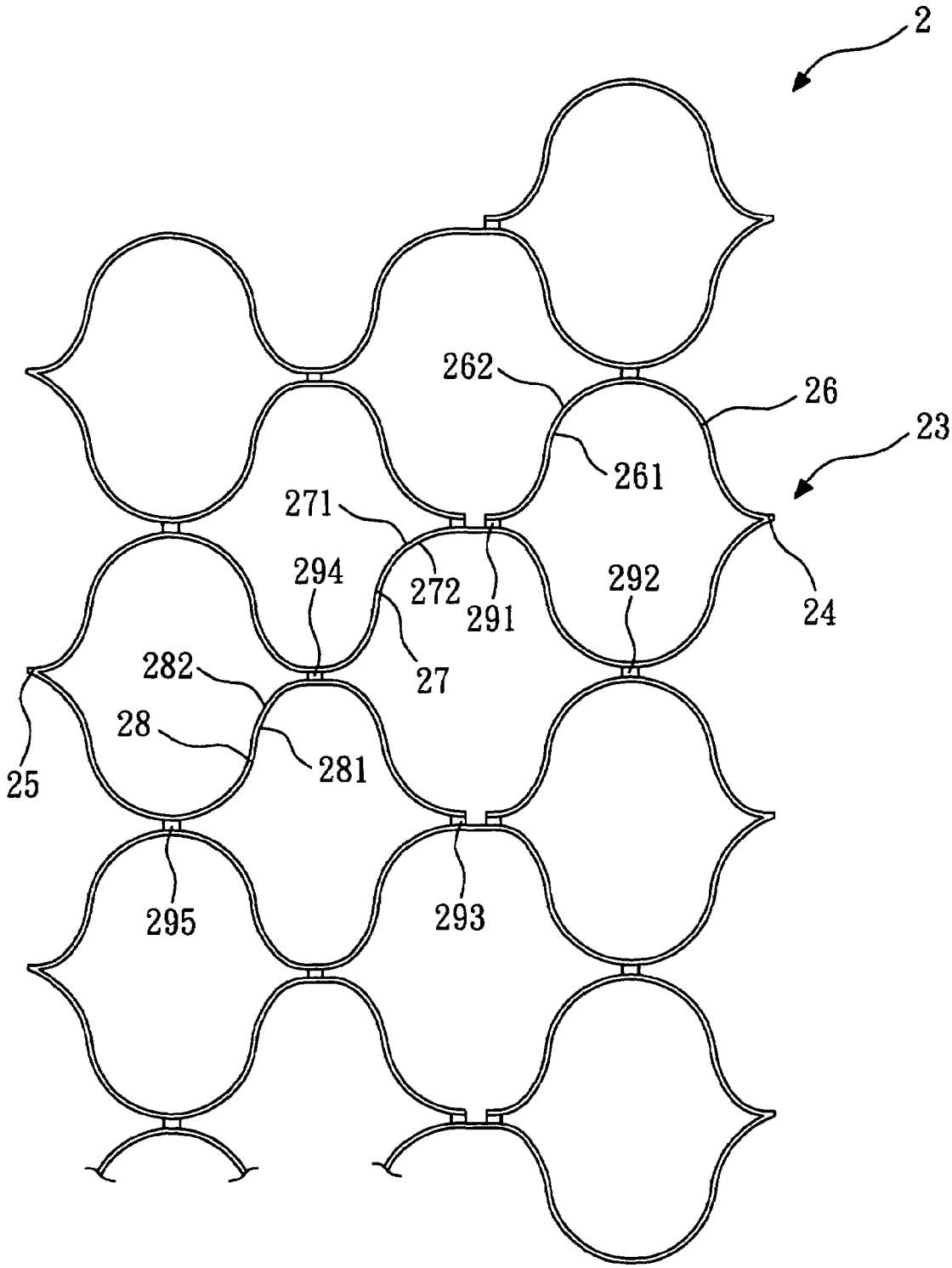
FIG. 4 (Prior Art)
FIG. 4 shows a schematic sectional view of a second kind of conventional foldable honeycomb structure.
Figure 5A:
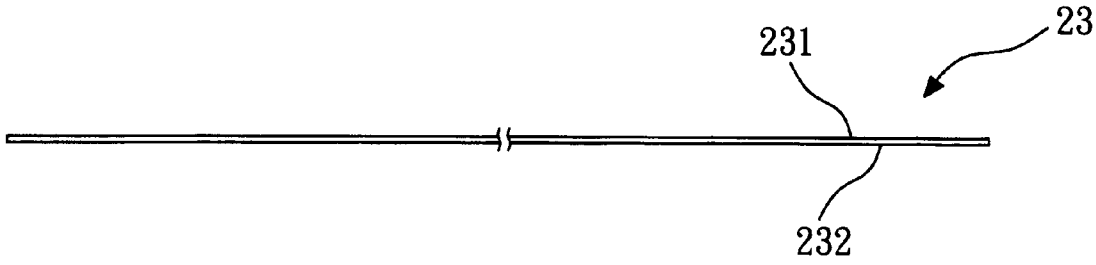
FIG. 5a (Prior Art)
FIGS. 5*a*-5*d* show schematic views of a method for making the conventional foldable honeycomb structure of FIG. 4.
Figure 5B:
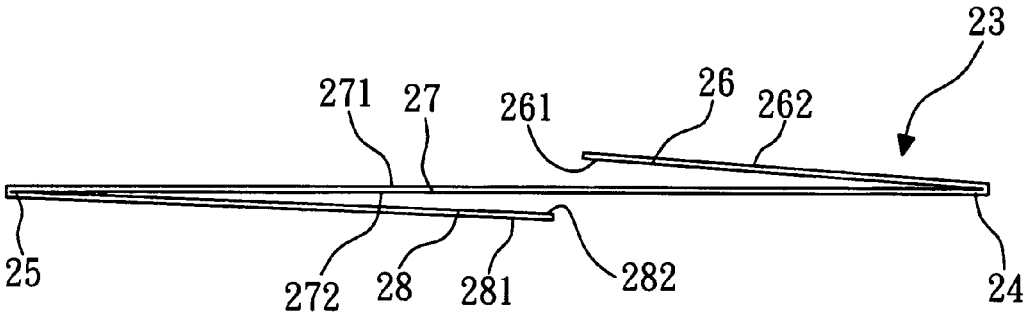
FIG. 5b (Prior Art)
Figure 5C:
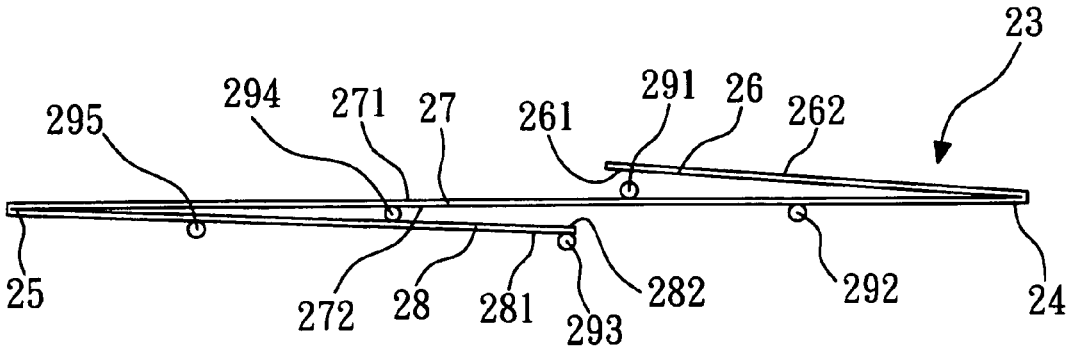
FIG. 5c (Prior Art)
Figure 5D:
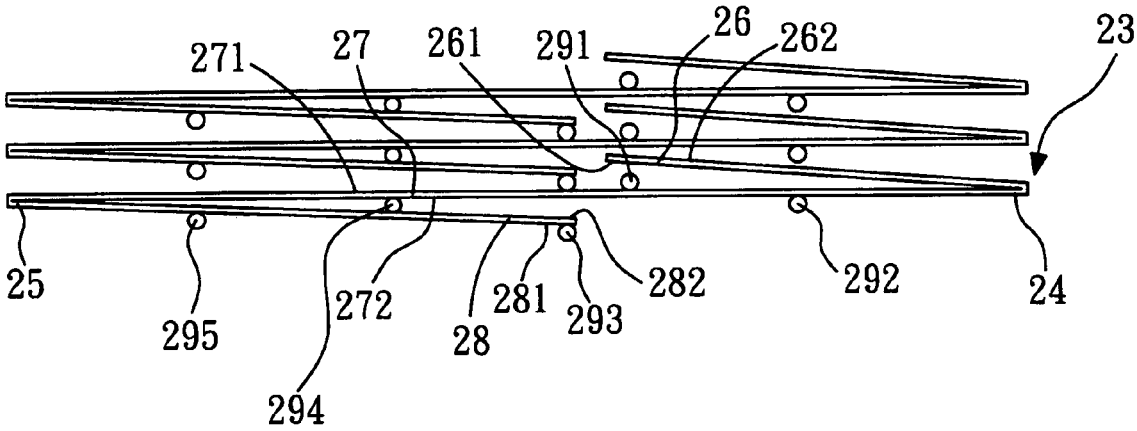
FIG. 5d (Prior Art)
Figure 6:
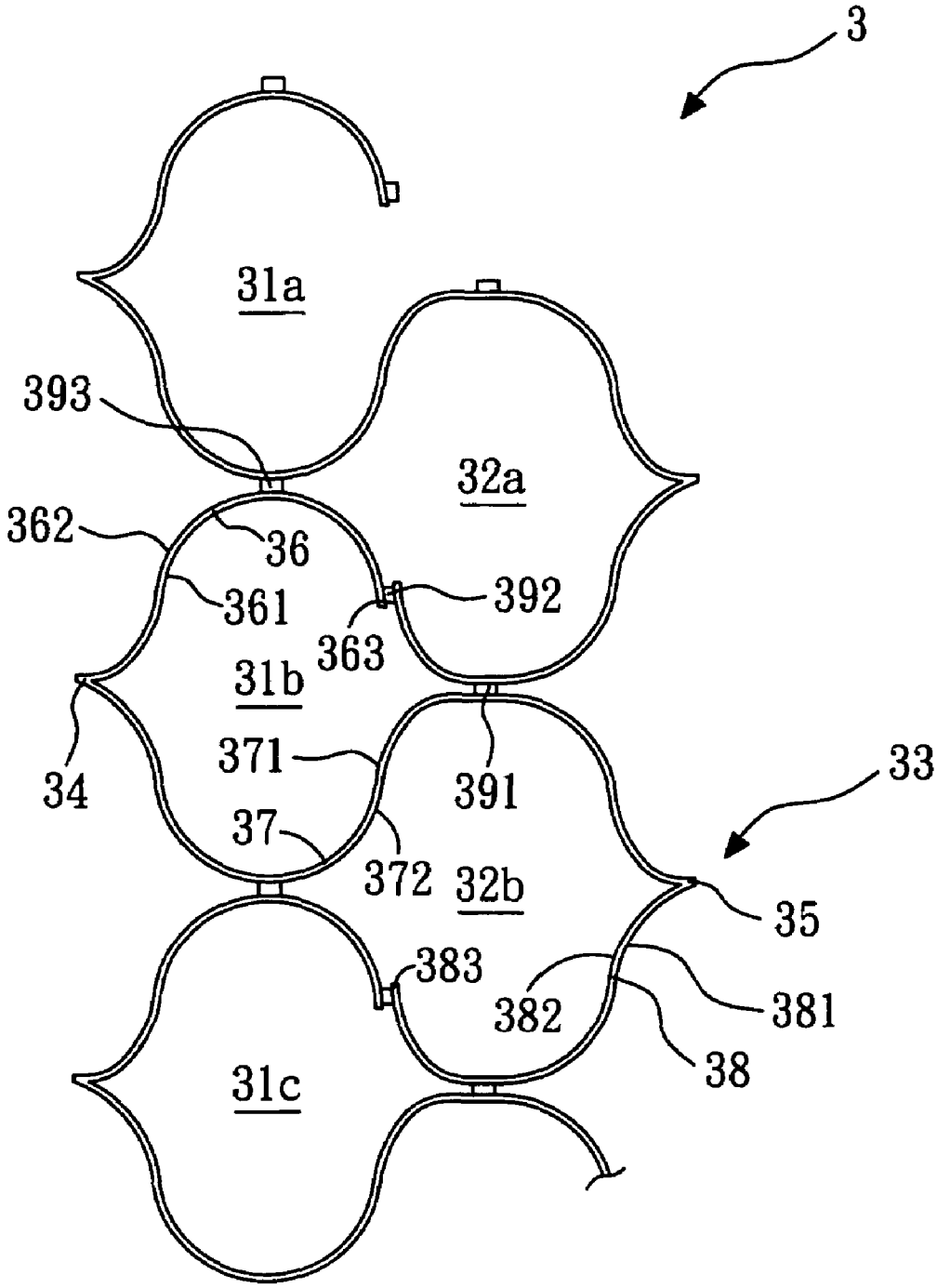
FIG. 6 shows a schematic sectional view of a foldable honeycomb structure in the first embodiment of the present invention.

Referring to FIG. 6, a schematic sectional view of a foldable honeycomb structure in a first embodiment of the present invention is shown. The foldable honeycomb structure 3 is applied to the thermal insulation devices such as window curtain or shield curtain, and can be texture or non-texture. The honeycomb structure 3 is of a double cell row structure, in which reference numbers 31*a*, 31*b*, 31*c*, 32*a*, 32*b* refer to a cell respectively, the cells 31*a*, 31*b*, 31*c* refer to a first row, and the cells 32*a*, 32*b* refer to a second row.

Referring to FIGS. 7*a* to 7*d*, schematic views of a method for making the foldable honeycomb structure in the first embodiment of the present invention of FIG. 6 are shown. First, referring to FIG. 7*a*, a plurality of flat strips 33 each has a length extending longitudinally are provided. It is to be noted that one strip 33 is illustrated in the embodiment. The strip 33 has a first surface 331 and a second surface 332.

Figure 7A:
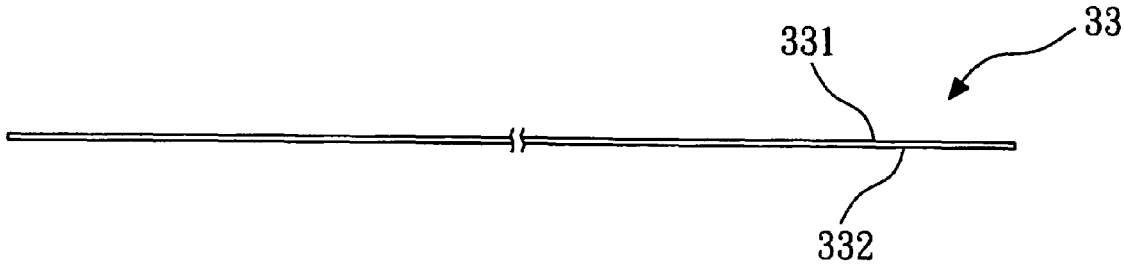
FIGS. 7*a*-7*d* show schematic views of a method for making the foldable honeycomb structure in the first embodiment of the present invention of FIG. 6.
Figure 7B:
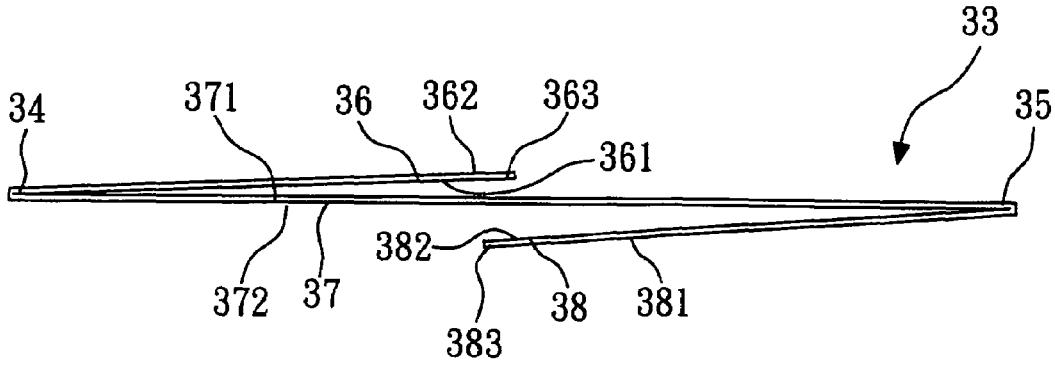

Next, referring to FIG. 7*b*, a first longitudinal crease 34 and a second longitudinal crease 35 are formed on the strip 33, so as to define a first longitudinal margin 36, a central portion 37 and a second longitudinal margin 38 on the strip 33. After that, the first longitudinal margin 36 of the strip 33 is folded towards one side (upside) of the strip 33 along the first longitudinal crease 34, and the second longitudinal margin 38 of the strip 33 is folded towards the other side (underside) of the strip 33 along the second longitudinal crease 35, thereby forming an approximate Z-shape appearance. The total width of the first longitudinal margin 36 and the second longitudinal margin 38 is slightly larger than that of the central portion 37. Preferably, the widths of the first longitudinal margin 36 and the second longitudinal margin 38 are the same, and both of them are slightly larger than half of the width of the central portion 37.

The first longitudinal margin 36 has a first surface 361, a second surface 362 and a free end 363. The central portion 37 has a first surface 371 and a second surface 372. The second longitudinal margin 38 has a first surface 381, a second surface 382 and a free end 383. The first surfaces 361, 371, 381 are the same as the first surface 31 of the strip 33, and the second surfaces 362, 372, 382 are the same as those of second surface 332 the strip 33. However, the folded strip 33 has a first exposed outside surface and a second exposed outside surface opposite to the first exposed outside surface, wherein the first exposed outside surface comprises the second surface 362 of the first longitudinal margin 36 and the surface where the first surface 371 of the central portion 37 and the first longitudinal margin 36 are not overlapped (i.e. the right side of the first surface 371); the second exposed outside surface comprises the first surface 381 of the second longitudinal margin 38 and the surface where the second surface 372 of the central portion 37 and the second longitudinal margin 38 are not overlapped (i.e. the left side of the second surface 372).

Figure 7C:
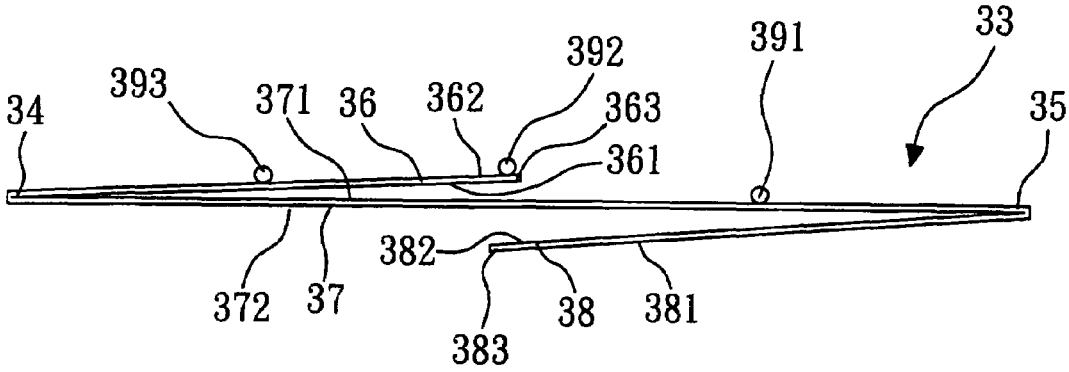

Then, referring to FIG. 7*c*, a first glue line 391, a second glue line 392 and a third glue line 393 are applied longitudinally to the exposed outside surface of the folded strip 33. In the embodiment, the first glue line 391, the second glue line 392 and the third glue line 393 are all applied to the first exposed outside surface, wherein the first glue line 391 is applied to the surface where the first surface 371 of the central portion 37 and the first longitudinal margin 36 are not overlapped (i.e. the right side of the first surface 371); the second glue line 392 and the third glue line 393 are applied to the second surface 362 of the first longitudinal margin 36, wherein the second glue line 392 is applied to the free end 363 of the first longitudinal margin 36; and the third glue line 393 is applied to the central position of the first longitudinal margin 36. It is understood that the first glue line 391, the second glue line 392 and the third glue line 393 can all be applied to the second exposed outside surface; or the first glue line 391, the second glue line 392 and the third glue line 393 can be applied to different exposed outside surfaces respectively.

Since the first glue line 391, the second glue line 392 and the third glue line 393 are all applied to the exposed outside surface, it is not necessary to open the first longitudinal margin 36 during the process of applying the glue lines, which can avoid the deformation of the strip 33 and have a precise gluing position. Moreover, the conventional strip opener can be omitted, thus simplifying the manufacturing equipment.

Figure 7D:
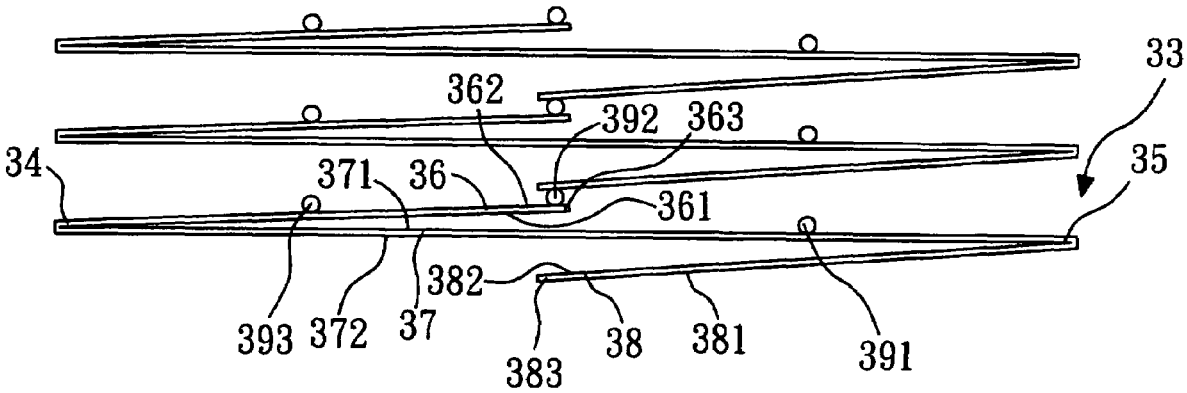

Then, Referring to FIG. 7*d*, the glued strips 33 are stacked, wherein the first glue line 391 is used for adhering the central portion 37 of the strip 33 to a longitudinal margin of an adjacent (upper) strip. The second glue line 392 is used for adhering the free end 363 of the first longitudinal margin 36 of the strip 33 to the free end of a longitudinal margin of the adjacent (upper) strip. The third glue line 393 is used for adhering the first longitudinal margin 36 of the strip 33 to a central portion of the adjacent (upper) strip. The expanded view of the strips after adhering is as shown in FIG. 6.

Returning to FIG. 6, the foldable honeycomb structure 3 is stacked by a plurality of folded strips 33, and each of the folded strip 33 comprises a first longitudinal crease 34, a second longitudinal crease 35, a central portion 37, a first longitudinal margin 36, a second longitudinal margin 38, a first glue line 391, a second glue line 392 and a third glue line 393. The central portion 37 is between the first longitudinal crease 34 and the second longitudinal crease 35. The first longitudinal margin 36 is folded towards one side (upside) of the central portion 37 along the first longitudinal crease 34. The second longitudinal margin 38 is folded towards the other side (underside) of the central portion 37 along the second longitudinal crease 35. The total width of the first longitudinal margin 36 and the second longitudinal margin 38 is slightly larger than that of the central portion 37. Preferably, the widths of the first longitudinal margin 36 and the second longitudinal margin 38 are the same, slightly larger than half of the width of the central portion 37.

The folded strip 33 has a first exposed outside surface and a second exposed outside surface opposite to the first exposed outside surface. The first glue line 391 is on the first exposed outside surface of the folded strip 33 and the central portion 37, which is used for adhering the central portion 37 to a longitudinal margin of an adjacent strip. The second glue line 392 is on the first exposed outside surface of the folded strip 33 and the free end of the first longitudinal margin 36, which is used for adhering the free end of the first longitudinal margin 36 to the free end of a longitudinal margin of the adjacent strip. The third glue line 393 is on the first exposed outside surface of the folded strip 33 and the first longitudinal margin 36, which is used for adhering the first longitudinal margin 36 to of a central portion of the adjacent strip.

Figure 8:
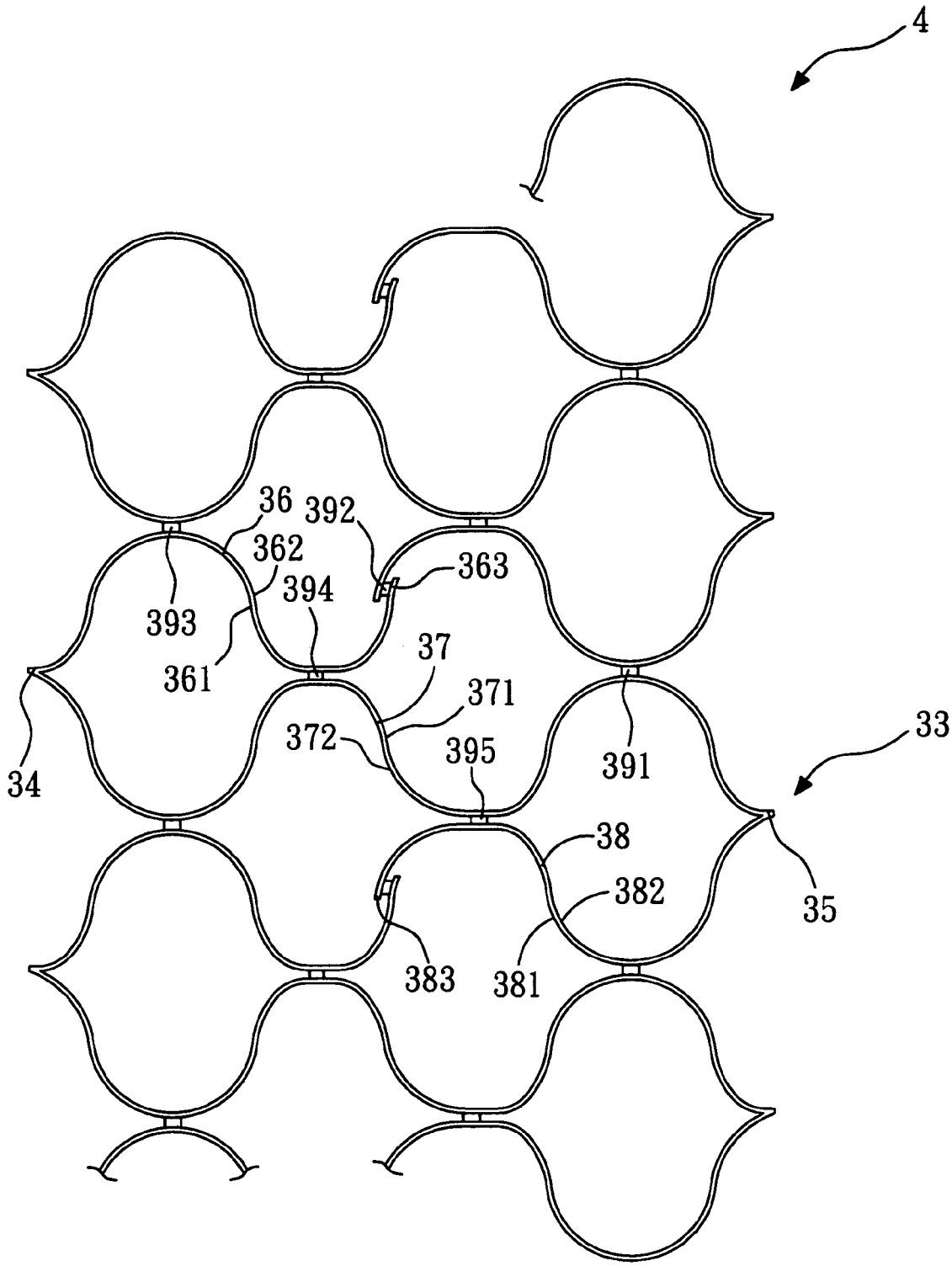
FIG. 8 shows a schematic sectional view of a foldable honeycomb structure in the second embodiment of the present invention.

Referring to FIG. 8, a schematic sectional view of a foldable honeycomb structure in a second embodiment of the present invention is shown. The foldable honeycomb structure 4 is a four-cell row structure.

Referring to FIGS. 9*a* to 9*d*, schematic views of a method for making a foldable honeycomb structure in the second embodiment of the present invention are shown. The method for making the present embodiment is substantially the same as that of the first embodiment, except that two more bonding lines are formed during the gluing step of the present embodiment. First, referring to FIG. 9*a*, a plurality of flat strips 33 each has a length extending longitudinally are provided. It is to be noted that one strip 33 is illustrated in the embodiment. The strip 33 has a first surface 331 and a second surface 332.

Figure 9A:
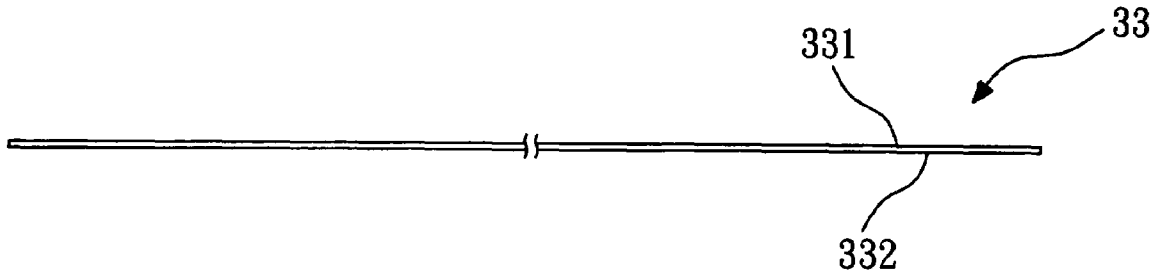
FIGS. 9*a*-9*d* show schematic views of a method for making the foldable honeycomb structure in the second embodiment of the present invention of FIG. 8.
Figure 9B:
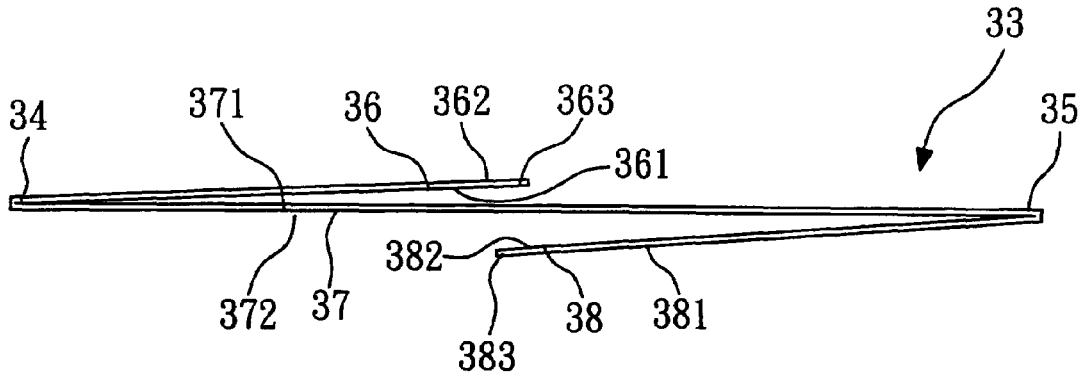

Next, referring to FIG. 9*b*, a first longitudinal crease 34 and a second longitudinal crease 35 are formed on the strip 33, so as to define a first longitudinal margin 36, a central portion 37 and a second longitudinal margin 38 on the strip 33. After that, the first longitudinal margin 36 of the strip 33 is folded towards one side (upside) of the strip 33 along the first longitudinal crease 34, and the second longitudinal margin 38 of the strip 33 is folded towards the other side (underside) of the strip 33 along the second longitudinal crease 35, thereby forming an approximate Z-shape appearance. The folded strip 33 is the same as the strip 33 of FIG. 7*b*, and both of them have a first exposed outside surface and a second exposed outside surface opposite to the first exposed outside surface, wherein the first exposed outside surface comprises the second surface 362 of the first longitudinal margin 36 and the surface where the first surface 371 of the central portion 37 and the first longitudinal margin 36 are not overlapped (i.e. the right side of the first surface 371); the second exposed outside surface comprises the first surface 381 of the second longitudinal margin 38 and the surface where the second surface 372 of the central portion 37 and the second longitudinal margin 38 are not overlapped (i.e. the left side of the second surface 372).

Figure 9C:
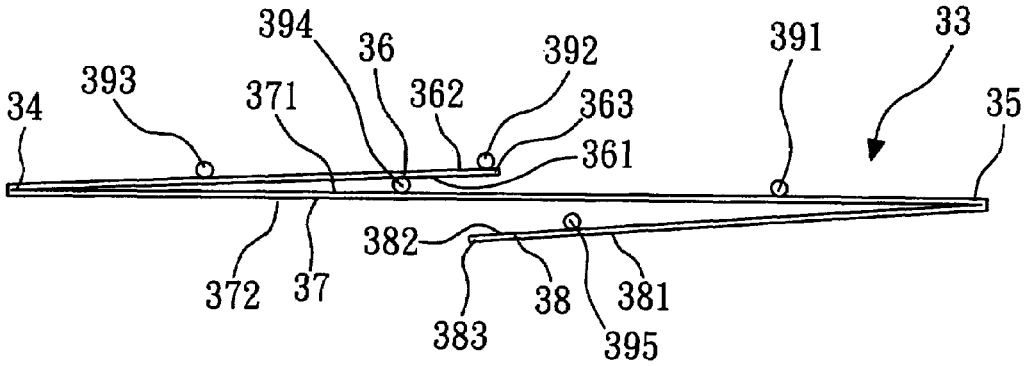

Then, referring to FIG. 9*c*, a first glue line 391, a second glue line 392 and a third glue line 393 are applied longitudinally, and a fourth bonding line 394 and a fifth bonding line 395 are formed. In the present embodiment, the first glue line 391, the second glue line 392 and the third glue line 393 are all applied to the first exposed outside surface, wherein the first glue line 391 is applied to the first surface 371 of the central portion 37 which is not overlapped by the first longitudinal margin 36 (i.e. the right side of the first surface 371), and the first glue line 391 is two fifths of the width of the second longitudinal margin 38 away from the second longitudinal crease 35. The second glue line 392 and the third glue line 393 are applied to the second surface 362 of the first longitudinal margin 36, wherein the second glue line 392 is applied to the free end 363 of the first longitudinal margin 36, and the third glue line 393 is two fifths of the width of the first longitudinal margin 36 away from the first longitudinal crease 34.

It is understood that the first glue line 391, the second glue line 392 and the third glue line 393 can all be applied to the second exposed outside surface; or the first glue line 391, the second glue line 392 and the third glue line 393 can be applied to different exposed outside surfaces respectively.

In the present embodiment, the fourth bonding line 394 is a fourth glue line 394, and the fifth bonding line 395 is a fifth glue line 395. The fourth bonding line 394 is on the inside surface where the first longitudinal margin 36 and the central portion 37 are overlapped in the folded strip 33, and it is four fifths of the width of the first longitudinal margin 36 away from the first longitudinal crease 34. The fifth bonding line 395 is on the inside surface where the second longitudinal margin 38 and the central portion 37 are overlapped in the folded strip 33, and it is four fifths of the width of the second longitudinal margin 38 away from the second longitudinal crease 35. It should be noted that the fourth bonding line 394 and the fifth bonding line 395 can also be bonded by using other bonding methods such as ultrasonic bonding or the like. In other applications, the fourth bonding line 394 and the fifth bonding line 395 can be formed previously, and the gluing operation (the first glue line 391, the second glue line 392 and the third glue line 393) is then carried out.

Figure 9D:
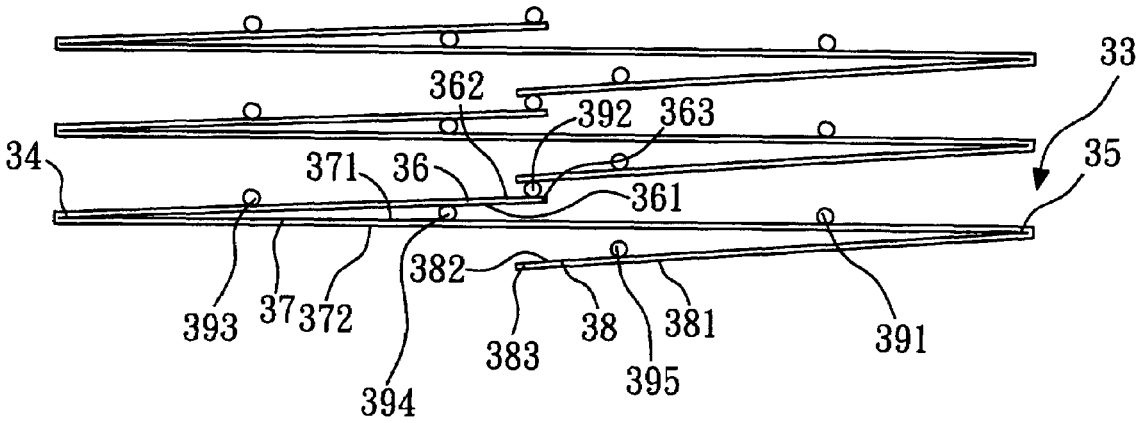

Next, referring to FIG. 9*d*, the glued strips 33 are stacked, wherein the first glue line 391 is used for adhering the central portion 37 of the strip 33 to a longitudinal margin of an adjacent (upper) strip; the second glue line 392 is used for adhering the free end 363 of the first longitudinal margin 36 of the strip 33 to the free end of a longitudinal margin of the adjacent (upper) strip; the third glue line 393 is used for adhering the first longitudinal margin 36 of the strip 33 to a central portion of the adjacent (upper)strip; the fourth bonding line 394 is used for bonding the first longitudinal margin 36 to the central portion 37; and the fifth bonding line 395 is used for bonding the second longitudinal margin 38 to the central portion 37. The expanded view of the strips after adhering is as shown in FIG. 8.

Returning to FIG. 8, the foldable honeycomb structure 4 is stacked by a plurality of folded strips 33, and each folded strip comprises a first longitudinal crease 34, a second longitudinal crease 35, a central portion 37, a first longitudinal margin 36, a second longitudinal margin 38, a first glue line 391, a second glue line 392, a third glue line 393, a fourth bonding line 394 and a fifth bonding line 395. The central portion 37 is between the first longitudinal crease 34 and the second longitudinal crease 35. The first longitudinal margin 36 is folded towards one side (upside) of the central portion 37 along the first longitudinal crease 34. The second longitudinal margin 38 is folded towards the other side (underside) of the central portion 37 along the second longitudinal crease 35. The total width of the first longitudinal margin 36 and the second longitudinal margin 38 is slightly larger than that of the central portion 37. Preferably, the width of the first longitudinal margin 36 is the same as that of the second longitudinal margin 38, and both of the widths are slightly larger than half of the width of the central portion 37.

The folded strip 33 has a first exposed outside surface and a second exposed outside surface opposite to the first exposed outside surface. The first glue line 391 is on the first exposed outside surface of the folded strip 33 and the central portion 37, which is used for adhering the central portion 37 to a longitudinal margin of an adjacent strip. The second glue line 392 is on the first exposed outside surface of the folded strip 33 and on the free end of the first longitudinal margin 36, which is used for adhering the free end 363 of the first longitudinal margin 36 to the free end of a longitudinal margin of the adjacent strip. The third glue line 393 is on the first exposed outside surface of the folded strip 33 and the first longitudinal margin 36, which is used for adhering the first longitudinal margin 36 to a central portion of the adjacent strip.

The fourth bonding line 394 is on the inside surface where the first longitudinal margin 36 and the central portion 37 are overlapped in the s folded strip 33, which is used for bonding the first longitudinal margin 36 to the central portion 37. The fifth bonding line 395 is positioned on the inside surface where the second longitudinal margin 38 and the central portion 37 are overlapped in the folded strip 33, which is used for bonding the second longitudinal margin 38 to the central portion 37.

Figure 10:
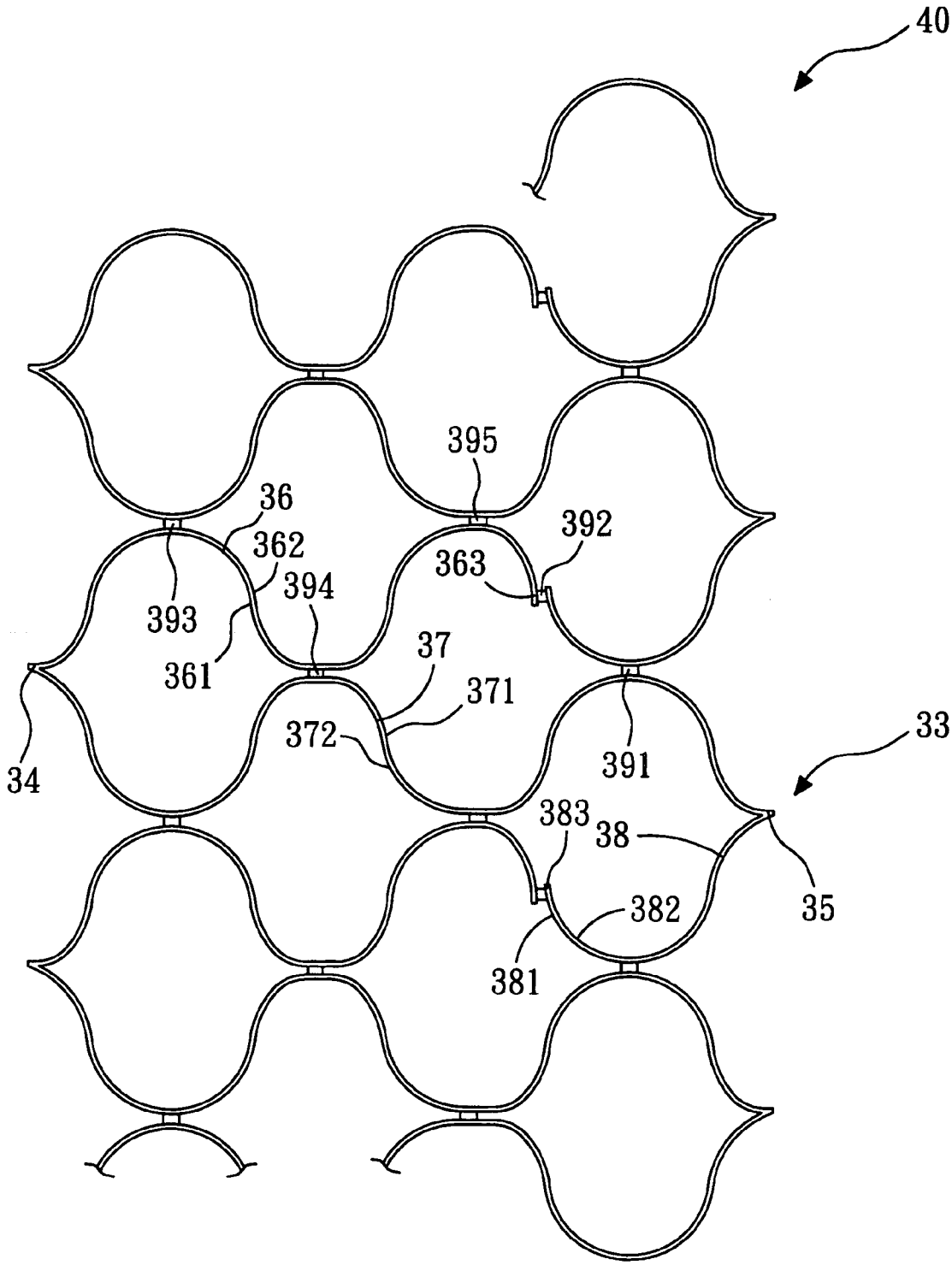
FIG. 10 shows a schematic sectional view of a foldable honeycomb structure in a third embodiment of the present invention.

Referring to FIG. 10, a schematic sectional view of a foldable honeycomb structure in a third embodiment of the present invention is shown. The foldable honeycomb structure 40 is a four-cell row structure.

Figure 11A:
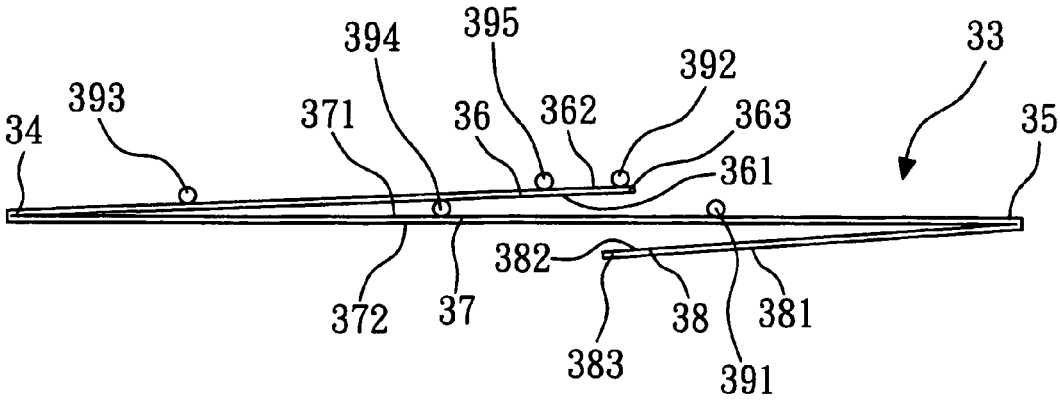
FIGS. 11*a* and 11*b* show schematic views of a method for making the foldable honeycomb structure in the third embodiment of the present invention of FIG. 10.
Figure 11B:
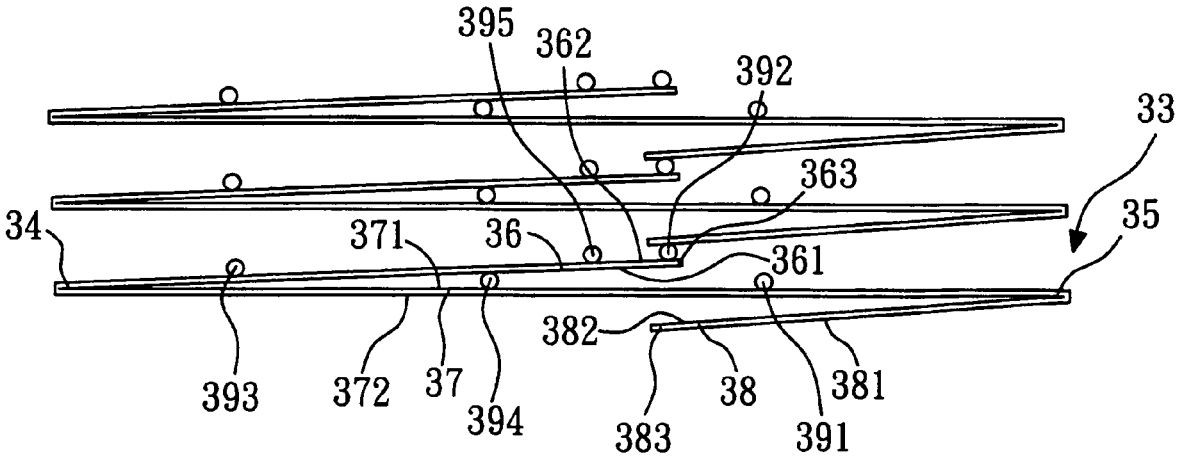

Referring to FIGS. 11*a* and 11*b*, schematic views of a method for making the foldable honeycomb structure in the third embodiment of the present invention of FIG. 10 are shown. The method for making the present embodiment is substantially the same as that of the second embodiment, except that in the present embodiment the width of the first longitudinal margin 36 is different from that of the second longitudinal margin 38, and the fifth bonding line 395 is in a different position. Preferably, in the present embodiment, the ratio of width of the first longitudinal margin 36 to the width of the second longitudinal margin 38 is approximately more than 3:2. In the present embodiment, the fifth bonding line 395 is on the second surface 362 of the first longitudinal margin 36 of the first exposed outside surface. Therefore, the fifth bonding line 395 is a fifth glue line 395. It should be noted that the corresponding positions of the first glue line 391, the second glue line 392, the third glue line 393 and the fourth glue line 394 are the same as that in the second embodiment, but they need to be adjusted slightly along horizontal direction. Referring to FIG. 11*b*, after the glued strips 33 are stacked, the fifth glue line 395 is used for adhering the first longitudinal margin 36 of the strip 33 to a central portion of an adjacent (upper) strip. The expanded view of after adhering is as shown in FIG. 10.

Returning to FIG. 10, the foldable honeycomb structure 40 is substantially the same as the foldable honeycomb structure 4 in the second embodiment, only except that in the present embodiment the width of the first longitudinal margin 36 is different from that of the second longitudinal margin 38, and the fifth bonding line 395 is in a different position. Preferably, in the present embodiment, the ratio of the width of the first longitudinal margin 36 to the width of the second longitudinal margin 38 is approximately more than 3:2. In the present embodiment, the fifth bonding line 395 is on the second surface 362 of the first longitudinal margin 36 of the first exposed outside surface. Therefore, the fifth bonding line 395 is a fifth glue line 395. The fifth glue line 395 is used for adhering the first longitudinal margin 36 of the strip 33 to a central portion of an adjacent (upper) strip.

Figure 12:
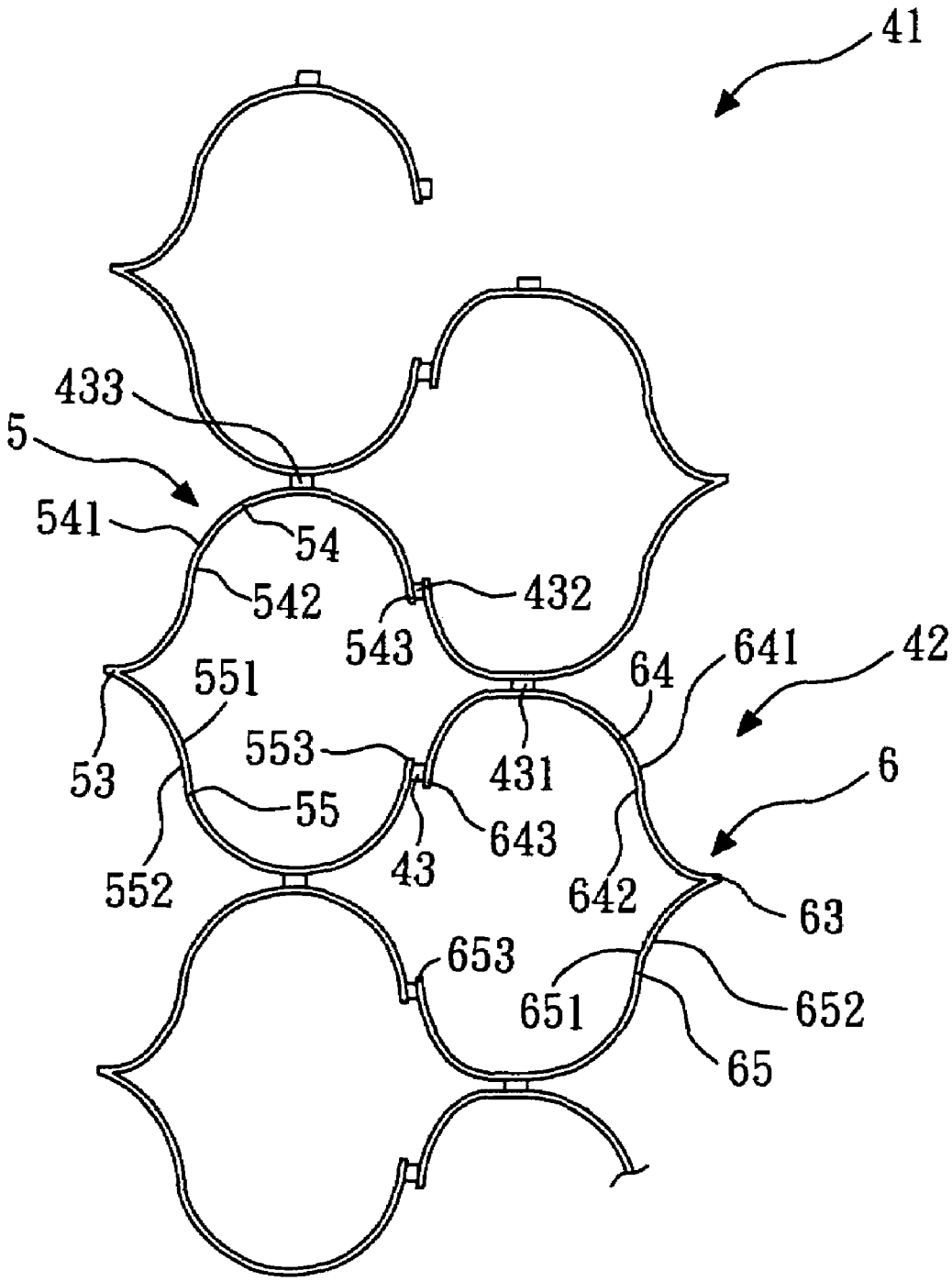
FIG. 12 shows a schematic sectional view of a foldable honeycomb structure in a fourth embodiment of the present invention.

Referring to FIG. 12, a schematic sectional view of a foldable honeycomb structure in a fourth embodiment of the present invention is shown. The foldable honeycomb structure 41 is a double-cell row structure.

Referring to FIGS. 13*a* to 13*e*, schematic views of a method for making the foldable honeycomb structure in the fourth embodiment of the present invention of FIG. 12 are shown. First, referring to FIG. 13*a*, a plurality of first strips 5 and a plurality of second strips 6 are provided. It is to be noted that one first strip 5 and one second strip 6 are illustrated in the embodiment. Both of the first strip 5 and the second strip 6 are flat and have a length extending longitudinally. In the present embodiment, the color or material of the first strip 5 is different from that of the second strip 6.

Figure 13A:
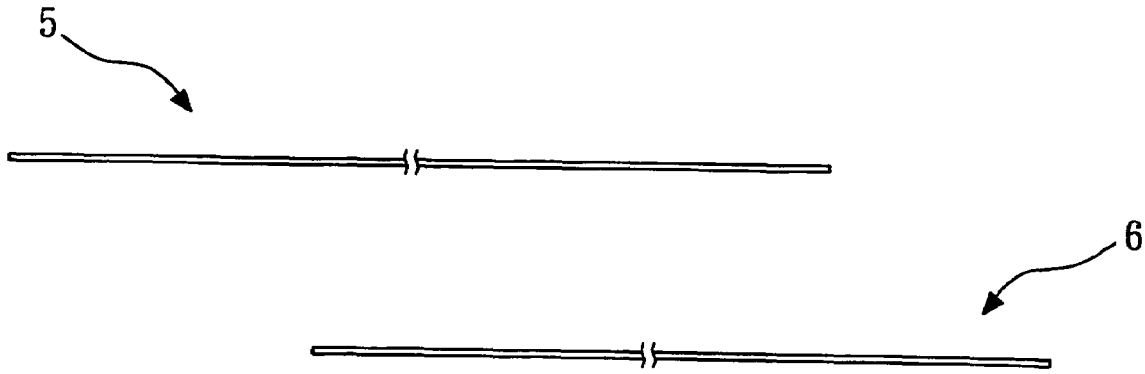
FIGS. 13*a*-13*e* show schematic views of a method for making the foldable honeycomb structure in the fourth embodiment of the present invention of FIG. 12.
Figure 13B:
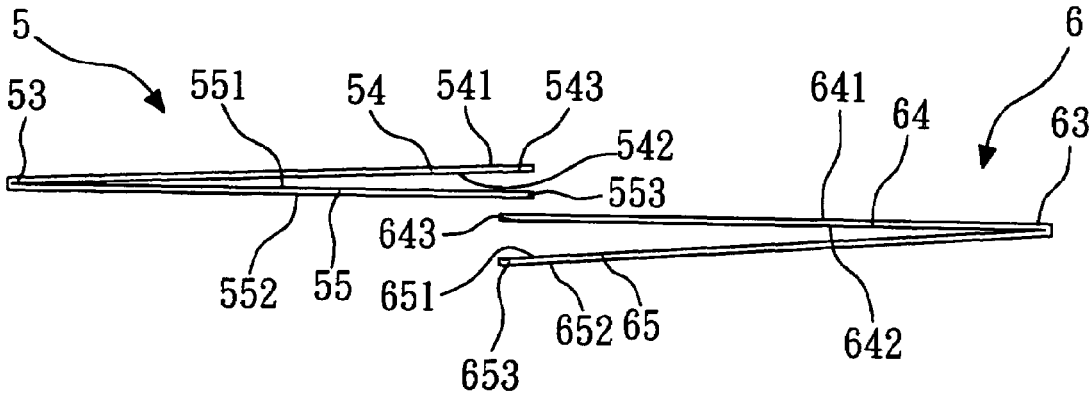

Next, referring to FIG. 13*b*, a first longitudinal crease 53 is formed on the first strip 5 and the first strip 5 is folded along the first longitudinal crease 53, thereby defining a first region 54 and a second region 55 on the first strip 5. The first region 54 has a first surface 541, a second surface 542 and a free end 543. The second region 55 has a first surface 551, a second surface 552 and a free end 553.

A second longitudinal crease 63 is formed on the second strip 6 and the second strip 6 is folded along the second longitudinal crease 63, thereby defining a third region 64 and a fourth region 65 on the second strip 6. The third region 64 has a first surface 641, a second surface 642 and a free end 643. The fourth region 65 has a first surface 651, a second surface 652 and a free end 653.

Figure 13C:
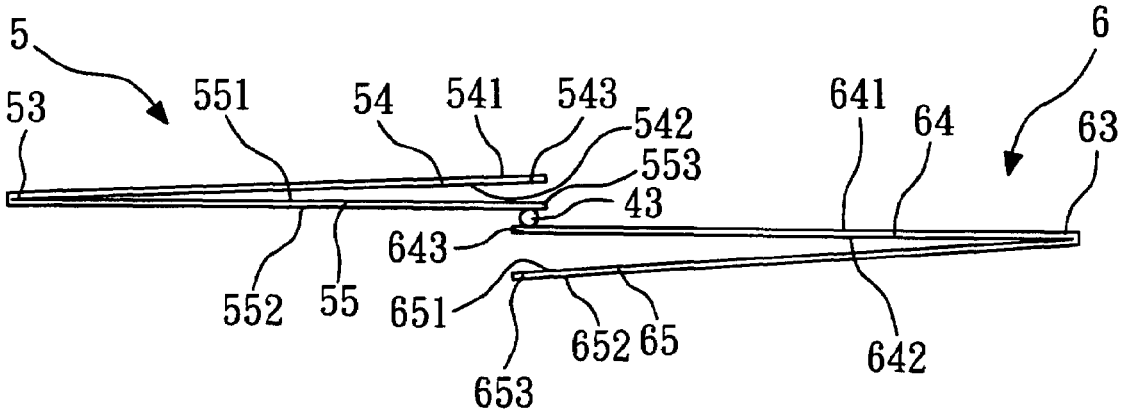

Next, referring to FIG. 13*c*, the free end 553 of the second region 55 is connected to the free end 643 of the third region 64, so as to form a combined strip 42. In the combined strip 42, the total width of the first region 54 and the fourth region 65 is larger than that of the second region 55 and the third region 64 after combination. In the present embodiment, a glue line 43 is used to connect the free end 553 of the second region 55 to the free end 643 of the third region 64. However, it can be understood that the free end 553 of the second region 55 can be connected to the free end 643 of the third region 64 by any other conventional methods.

The combined strip 42 has a first exposed outside surface and a second exposed outside surface opposite to the first exposed outside surface. The first exposed outside surface comprises the first surface 541 of the first region 54 and the first surface 641 of the third region 64. The second exposed outside surface comprises the second surface 552 of the second region 55 and the second surface 652 of the fourth region 65.

Figure 13D:
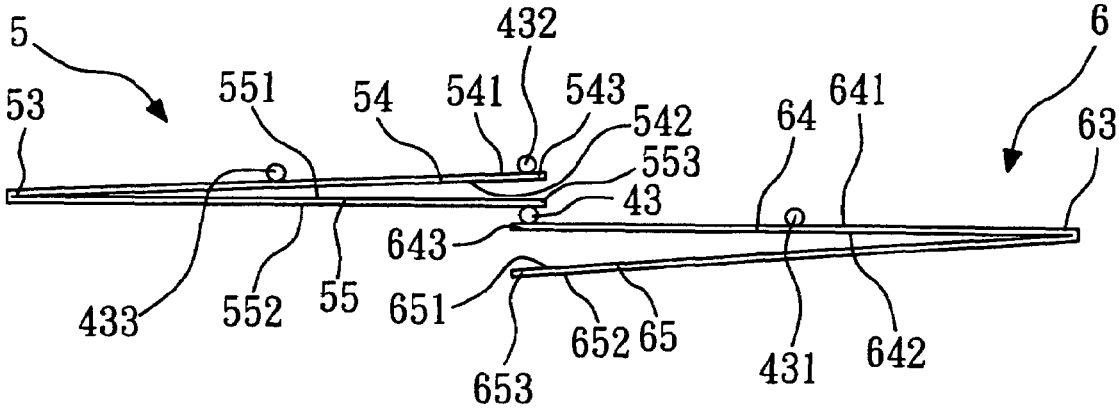

Next, referring to FIG. 13*d*, a first glue line 431, a second glue line 432 and a third glue line 433 are applied longitudinally to the same exposed outside surface of the combined strip 42. In the present embodiment, the first glue line 431, the second glue line 432 and the third glue line 433 are all applied to the first exposed outside surface, wherein the first glue line 431 is applied to the third region 64, preferably, on the central portion of the third region 64. The second glue line 432 is applied to the free end 543 of the first region 54. The third glue line 433 is applied to the first region 54, preferably, on the central portion of the first region 54. It can be understood that the first glue line 431, the second glue line 432 and the third glue line 433 can also be applied to the second exposed outside surface; or the first glue line 431, the second glue line 432 and the third glue line 433 can be applied to different exposed outside surfaces respectively.

Figure 13E:
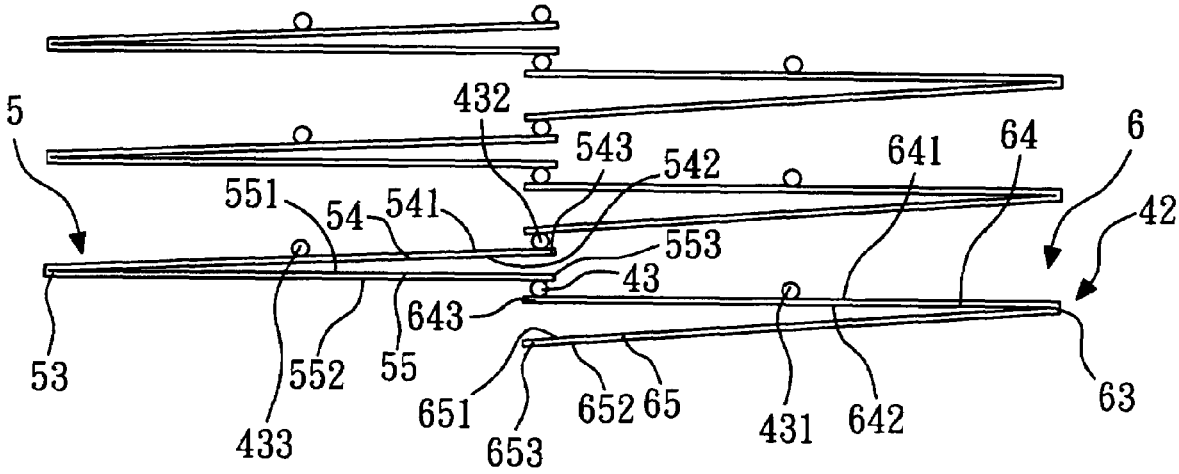

Next, referring to FIG. 13*e*, the glued combined strips 42 are stacked, wherein the first glue line 431 is used for adhering the third region 64 to a fourth region of an adjacent (above) combined strip. The second glue line 432 is used for adhering the free end 543 of the first region 54 to the free end of a fourth region of the adjacent (above) combined strip. The third glue line 433 is used for adhering the first region 54 to a second region of the adjacent (above) combined strip. The expanded view after adhering is as shown in FIG. 12.

Returning to FIG. 12, the foldable honeycomb structure 41 is stacked by a plurality of combined strips 42, and each combined strip 42 comprises a first strip 5, a second strip 6, a first glue line 431, a second glue line 432 and a third glue line 433.

The first strip 5 comprises a first longitudinal crease 53, a first region 54 and a second region 55. The first region 54 is folded towards the second region 55 along the first longitudinal crease 53, and the first region 54 and the second region 55 each has a free end. The second strip 6 comprises a second longitudinal crease 63, a third region 64 and a fourth region 65. The third region 64 is folded towards the fourth region 65 along the second longitudinal crease 63, and the third region 64 and the fourth region 65 each has a free end. The free end of the third region 64 is connected to the free end of the second region 55 by using a glue line 43, so as to form a combined strip 42 which has a first exposed outside surface and a second exposed outside surface opposite to the first exposed outside surface.

The first glue line 431 is on the first exposed outside surface of the combined strip 42 and the third region 64, which is used for adhering the third region 64 to a fourth region of an adjacent combined strip. The second glue line 432 is on the first exposed outside surface of the combined strip 42 and the free end 543 of the first region 54, which is used for adhering the free end 543 of the first region 54 to the free end of a fourth region of the adjacent combined strip. The third glue line 433 is on the first exposed outside surface of the combined strip 42 and the first region 54, which is used for adhering the first region 54 to a second region of the adjacent combined strip.

It can be understood that the first glue line 431, the second glue line 432 and the third glue line 433 can also be applied to the second exposed outside surface; or the first glue line 431, the second glue line 432 and the third glue line 433 can be applied to different exposed outside surfaces respectively.

The material or manufacturing process of the first strip 5 can be different from those of the second strip 6, such that the combined functionality can be increased.

Figure 14:
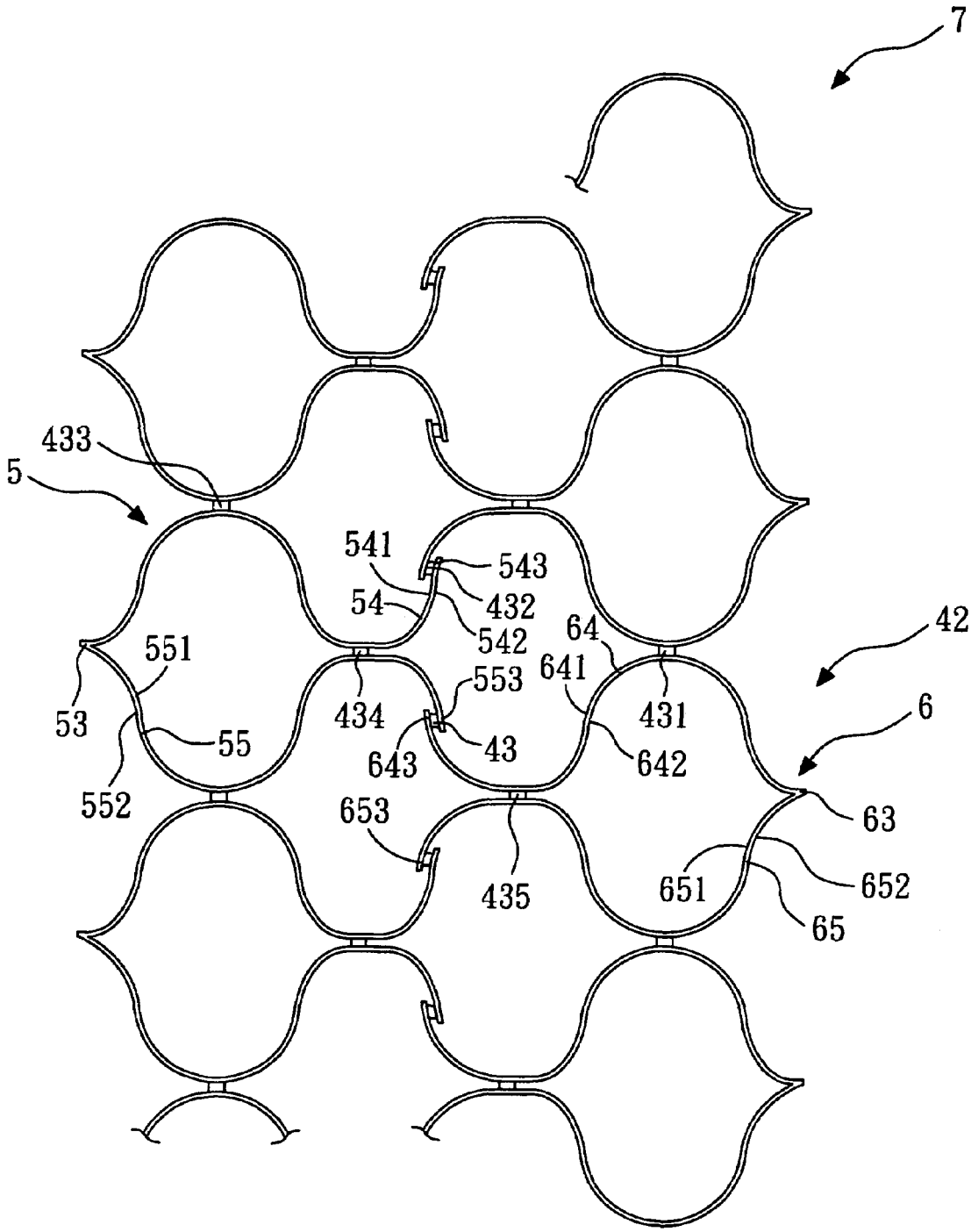
FIG. 14 shows a schematic sectional view of a foldable honeycomb structure in the fifth embodiment of the present invention.

Referring to FIG. 14, a schematic sectional view of a foldable honeycomb structure in a fifth embodiment of the present invention is shown. The foldable honeycomb structure 7 is a four-cell row structure.

Referring to FIGS. 15*a* to 15*d*, schematic views of a method for making the foldable honeycomb structure in the fifth embodiment of the present invention of FIG. 14 are shown. The method for making the present embodiment is substantially the same as that of the fourth embodiment, only except that two more bonding lines are formed in the gluing step of the present embodiment.

Figure 15A:
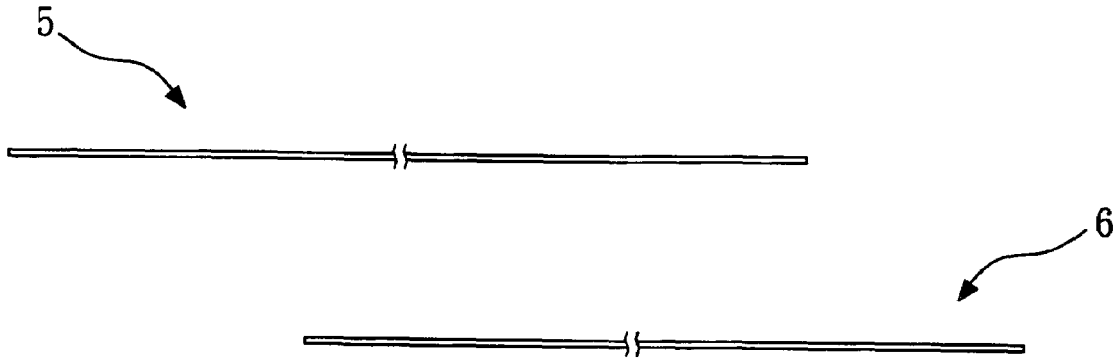
FIGS. 15*a*-15*e* show schematic views of a method for making the foldable honeycomb structure in the fifth embodiment of the present invention of FIG. 14.

First, referring to FIG. 15*a*, a plurality of first strips 5 and a plurality of second strips 6 are provided. It is to be noted that one first strip 5 and one second strip 6 are illustrated in the embodiment. Both of the first strip 5 and the second strip 6 are flat and have a length extending longitudinally.

Figure 15B:
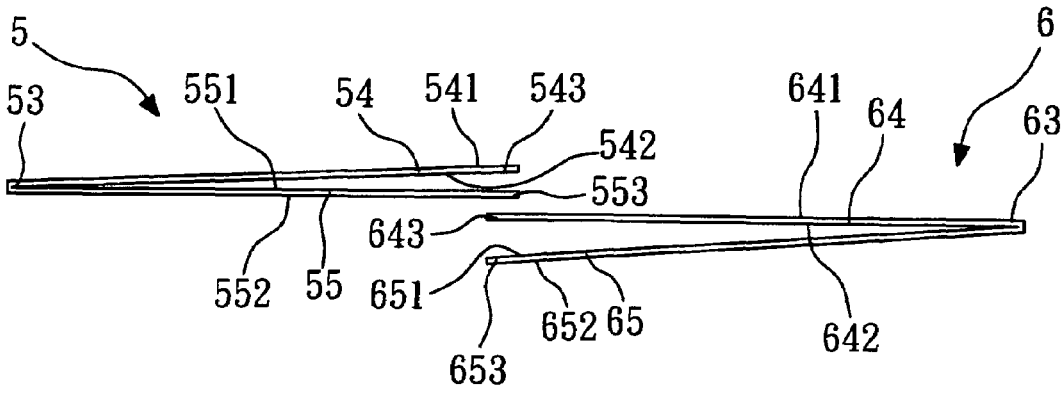

Next, referring to FIG. 15*b*, a first longitudinal crease 53 is formed on the first strip 5 and the first strip 5 is folded along the first longitudinal crease 53, thereby defining a first region 54 and a second region 55 on the first strip 5. The first region 54 has a first surface 541, a second surface 542 and a free end 543. The second region 55 has a first surface 551, a second surface 552 and a free end 553.

A second longitudinal crease 63 is formed on the second strip 6 and the second strip 6 is folded along the second longitudinal crease 63, thereby defining a third region 64 and a fourth region 65 on the second strip 6. The third region 64 has a first surface 641, a second surface 642 and a free end 643. The fourth region 65 has a first surface 651, a second surface 652 and a free end 653.

Figure 15C:
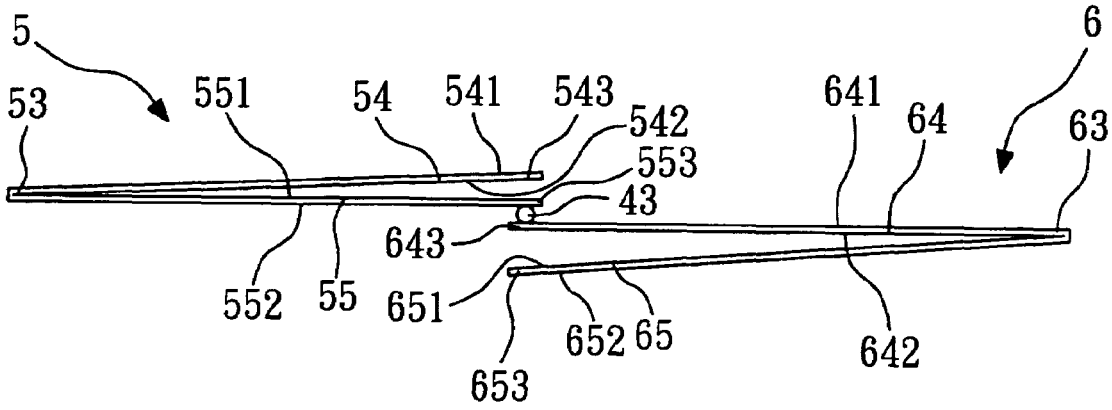

Next, referring to FIG. 15*c*, the free end 553 of the second region 55 is connected to the free end 643 of the third region 64, so as to form a combined strip 42. In the combined strip 42, the total width of the first region 54 and the fourth region 65 is larger than that of the second region 55 and the third region 64 after combination. In the present embodiment, a glue line 43 is used to connect the free end 553 of the second region 55 to the free end 643 of the third region 64. However, it can be understood that the free end 553 of the second region 55 can be connected to the free end 643 of the third region 64 by any other conventional method such as ultrasonic bonding or the like.

The combined strip 42 has a first exposed outside surface and a second exposed outside surface opposite to the first exposed outside surface. The first exposed outside surface comprises the first surface 541 of the first region 54 and the first surface 641 of the third region 64. The second exposed outside surface comprises the second surface 552 of the second region 55 and the second surface 652 of the fourth region 65.

Figure 15D:
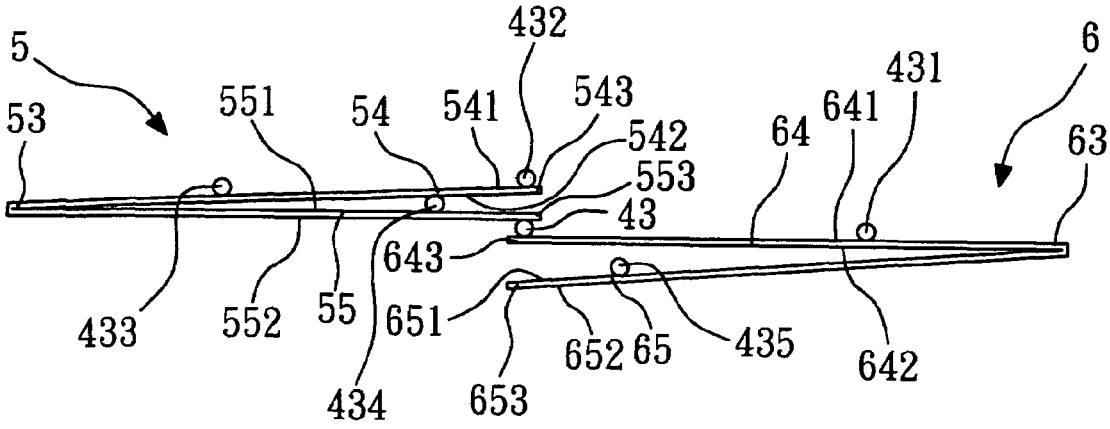

Next, referring to FIG. 15*d*, a first glue line 431, a second glue line 432, and a third glue line 433 are applied longitudinally to the combined strip 42, and a fourth bonding line 434 and a fifth bonding line 435 are formed on the combined strip 42. The first glue line 431, the second glue line 432 and the third glue line 433 are all applied to the first exposed outside surface, wherein the first glue line 431 is applied to the third region 64, preferably, the first glue line 431 is about two fifths of the width of the third region 64 away from the second longitudinal crease 63. The second glue line 432 is applied to the free end 543 of the first region 54. The third glue line 433 is applied to the first region 54, preferably, the third glue line 433 is about two fifths of the width of the first region 54 away from the first longitudinal crease 53.

It can be understood that the first glue line 431, the second glue line 432 and the third glue line 433 can also be applied to the second exposed outside surface; or the first glue line 431, the second glue line 432 and the third glue line 433 can be applied to different exposed outside surfaces respectively.

In the embodiment, the fourth bonding line 434 is a fourth glue line 434, and the fifth bonding line 435 is a fifth glue line 435. The fourth bonding line 434 is on the inside surface where the first region 54 and the second region 55 are overlapped in the combined strip 42, i.e. the second surface 542 of the first region 54 or the first surface 551 of the second region 55. The fourth bonding line 434 is about four fifths of the width of the second region 55 away from the first longitudinal crease 53. The fifth bonding line 435 is on the inside surface where the third region 64 and the fourth region 65 are overlapped in the combined strip 42, i.e. the second surface 642 of the third region 64 or the first surface 651 of the fourth region 65. The fifth bonding line 435 is about four fifths of the width of the fourth region 64 away from the second longitudinal crease 63. It should be noted that the fourth bonding line 434 and the fifth bonding line 435 can also be bonded by other bonding methods such as ultrasonic bonding or the like. In other applications, the fourth bonding line 434 and the fifth bonding line 435 can be formed previously, and the gluing operation (the first glue line 431, the second glue line 432 and the third glue line 433) is then carried out.

Figure 15E:
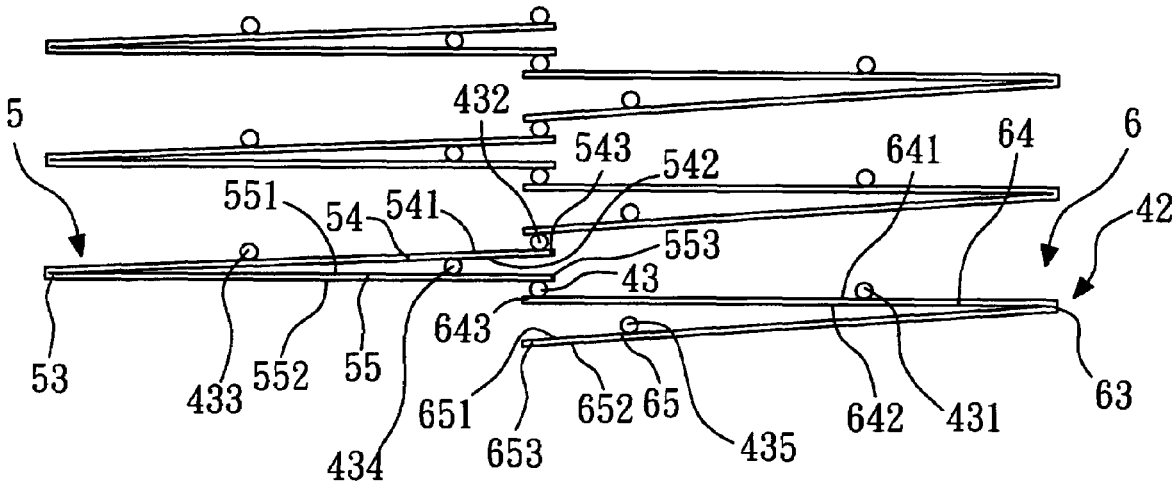

Next, referring to FIG. 15*e*, the glued combined strips 42 are stacked, wherein the first glue line 431 is used for adhering the third region 64 to a fourth region of an adjacent (upper) combined strip. The second glue line 432 is used for adhering the free end 543 of the first region 54 to the free end of a fourth region of the adjacent (upper) combined strip. The third glue line 433 is used for adhering the first region 54 to a second region of the adjacent (upper) combined strip. The fourth bonding line 434 is used for bonding the first region 54 to the second region 55. The fifth bonding line 435 is used for bonding the third region 64 to the fourth region 65. The expanded view after adhering is as shown in FIG. 14.

Returning to FIG. 14, the foldable honeycomb structure 7 is stacked by a plurality of combined strips 42. Each combined strip 42 comprises a first strip 5, a second strip 6, a first glue line 431, a second glue line 432, a third glue line 433, a fourth bonding line 434 and a fifth bonding line 435.

The first strip 5 comprises a first longitudinal crease 53, a first region 54 and a second region 55. The first region 54 is folded towards the second region 55 along the first longitudinal crease 53, and the first region 54 and the second region 55 each has a free end. The second strip 6 comprises a second longitudinal crease 63, a third region 64 and a fourth region 65. The third region 64 is folded towards the fourth region 65 along the second longitudinal crease 63, and the third region 64 and the fourth region 65 each has a free end. The free end of the third region 64 is connected to the free end of the second region 55, so as to form a combined strip 42 which has a first exposed outside surface and a second exposed outside surface opposite to the first exposed outside surface.

The first glue line 431 is on the first exposed outside surface of the combined strip 42 and the third region 64, which is used for adhering the third region 64 to a fourth region of an adjacent combined strip. The second glue line 432 is on the first exposed outside surface of the combined strip 42 and the free end 543 of the first region 54, which is used for adhering the free end 543 of the first region 54 to the free end of a fourth region of the adjacent combined strip. The third glue line 433 is on the first exposed outside surface of the combined strip 42 and the first region 54, which is used for adhering the first region 54 to a second region of the adjacent combined strip. The fourth bonding line 434 is on the inside surface where the first region 54 and the second region 55 are overlapped in the combined strip 42, i.e., the second surface 542 of the first region 54 or the first surface 551 of the second region 55, and the fourth bonding line 434 is used for bonding the first region 54 to the second region 55. The fifth bonding line 435 is on the inside surface where the third region 64 and the fourth region 65 are overlapped in the combined strip 42, i.e., the second surface 642 of the third region 64 or the first surface 651 of the fourth region 65, and the fifth bonding line 435 is used for bonding the third region 64 to the fourth region 65.

Figure 16:
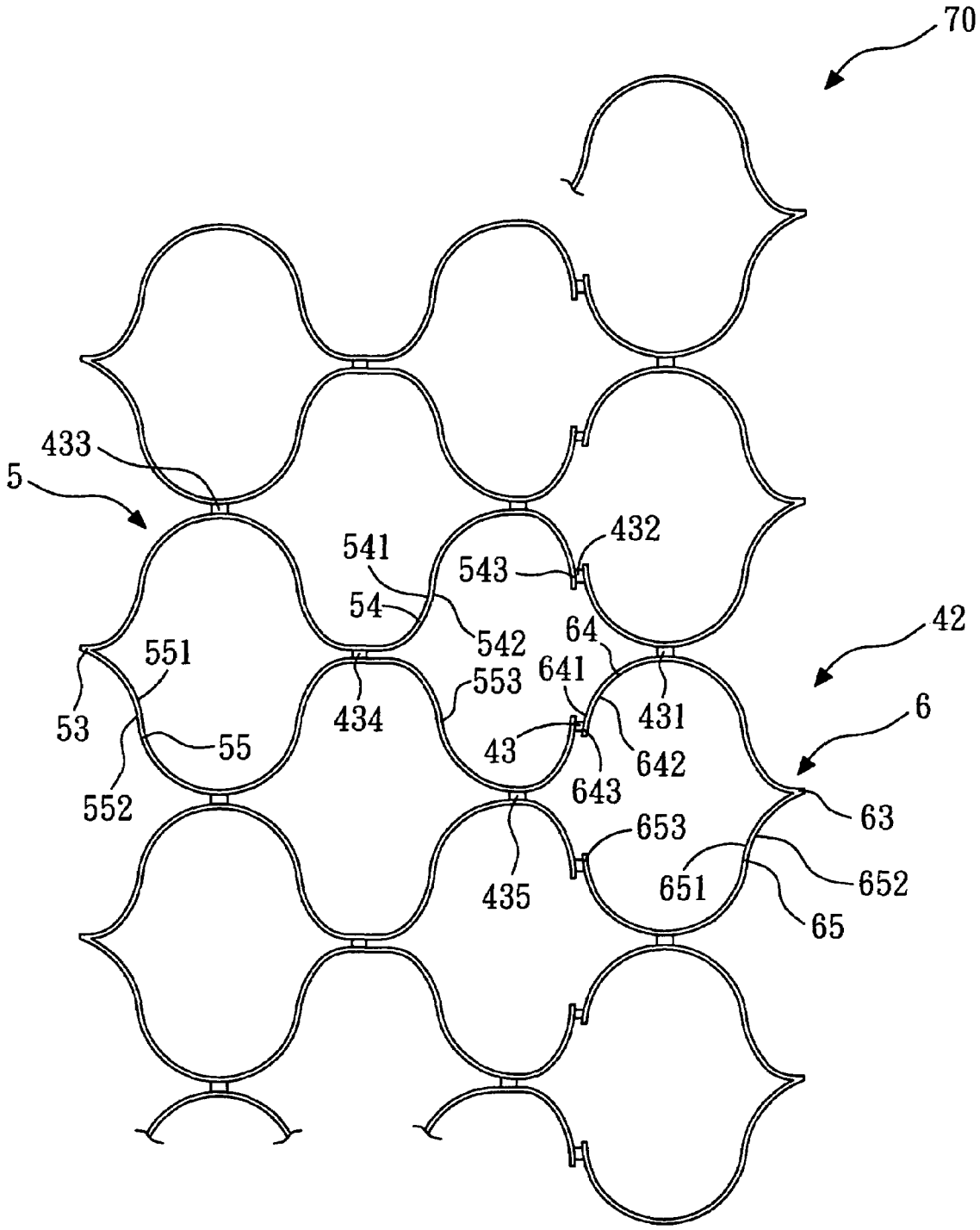
FIG. 16 shows a schematic sectional view of a foldable honeycomb structure in a sixth embodiment of the present invention.

Referring to FIG. 16, a schematic sectional view of a foldable honeycomb structure in a sixth embodiment of the present invention is shown. The foldable honeycomb structure 70 is a four-cell row structure.

Figure 17A:
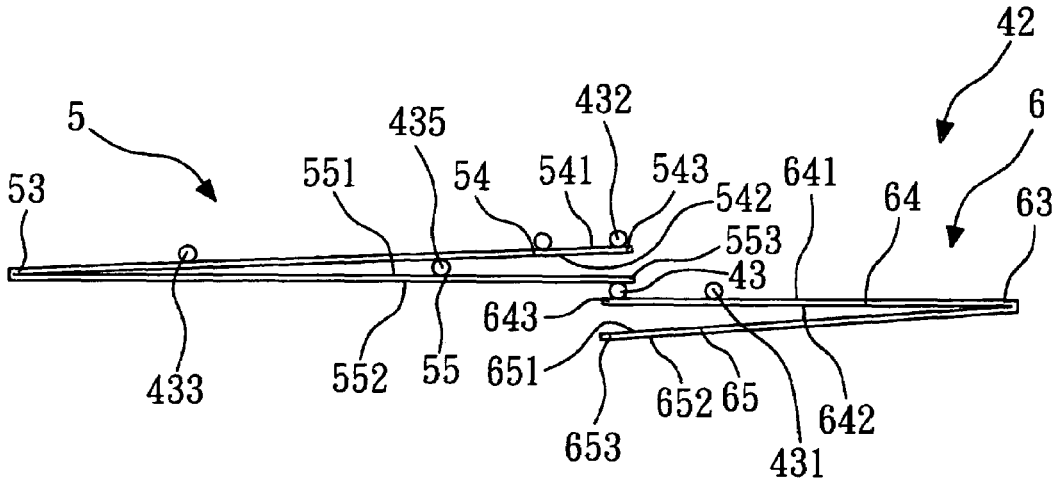
FIGS. 17*a* and 17*b* show schematic views of a method for making the foldable honeycomb structure in the sixth embodiment of the present invention of FIG. 16.
Figure 17B:
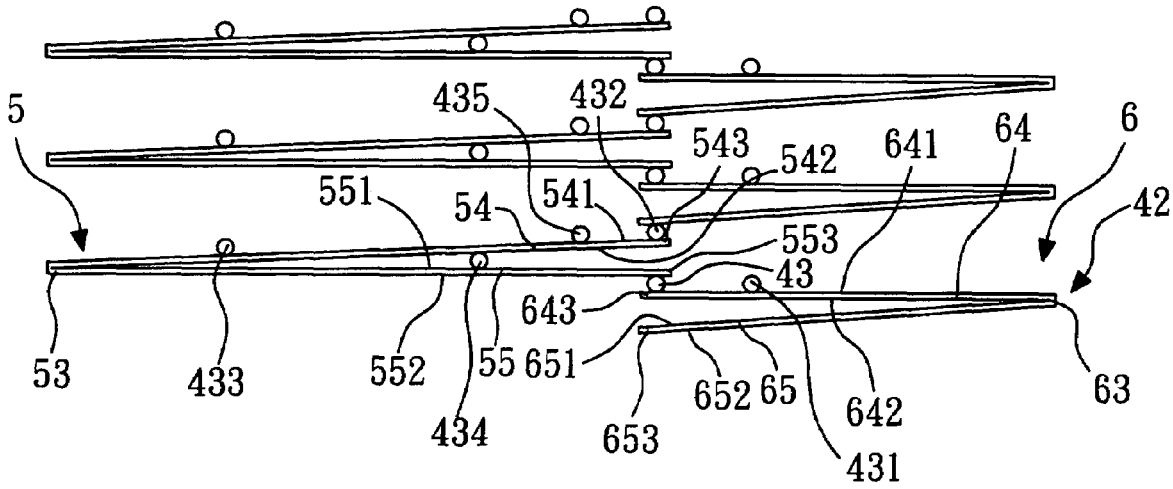

Referring to FIGS. 17*a* and 17*b*, schematic views of a method for making the foldable honeycomb structure in the sixth embodiment of the present invention of FIG. 16 are shown. The method for making the present embodiment is substantially the same as that of the fifth embodiment, only except that in the present embodiment the width of the first strip 5 is different from that of the second strip 6 (i.e. the width of the first region 54 is different from that of the third region 64), and the fifth bonding line 435 is in a different position. Preferably, in the present embodiment, the ratio of the width of the first region 54 to the width of the third region 64 is approximately larger than 3:2. In the embodiment, the fifth bonding line 435 is on the first surface 541 of first region 54 of the first exposed outside surface. Therefore, the fifth bonding line 435 is a fifth glue line 435. It should be noted that the corresponding positions of the first glue line 431, the second glue line 432, the third glue line 433 and the fourth glue line 434 are the same as those of the fifth embodiment, but they need to be adjusted slightly along horizontal direction. Referring to FIG. 17*b*, after the glued combined strips 42 are stacked, the fifth glue line 435 is used for adhering the first region 54 to a second region of an adjacent combined strip. The expanded view after adhering is as shown in FIG. 16.

Returning to FIG. 16, the foldable honeycomb structure 70 is substantially the same as the foldable honeycomb structure 7 of the fifth embodiment, only except that in the present embodiment the width of the first strip 5 is different from that of the second strip 6, and the fifth bonding line 435 is in a different position. Preferably, in the present embodiment, the ratio of the width of the first region 54 to the width of the third region 64 is approximately more than 3:2. In the present embodiment, the fifth bonding line 435 is on the first surface 541 of the first region 54 of the first exposed outside surface. Therefore, the fifth bonding line 435 is a fifth glue line 435. The fifth glue line 435 is used for adhering the first region 54 to a second region of an adjacent combined strip.

While several embodiments of the present invention have been illustrated and described, various modifications and improvements can be made by those skilled in the art. The embodiments of the present invention are therefore described in an illustrative but not restrictive sense. It is intended that the present invention may not be limited to the particular forms as illustrated, and that all modifications which maintain the spirit and scope of the present invention are within the scope as defined in the appended claims.

What is claimed is:

1. A method of making a foldable honeycomb structure, comprising the steps of:

(a) providing a plurality of flat strips;

(b) folding each of the flat strips in opposite directions about first and second lines each extending the length of the strip to form a plurality of folded strips, whereby each of the folded strips includes a central portion, a first longitudinal margin folded towards one side of the central portion about a first longitudinal crease, and a second longitudinal margin folded towards the other side of the central portion about a second longitudinal crease, and each of the folded strips has a first side and a second side facing in opposite directions where surfaces of the folded strip are outwardly exposed;

(c) applying glue to each of the folded strips, respectively, along a first line, a second line and a third line each extending longitudinally on a respective one of the exposed surfaces at the first side or the second side of the folded strip, whereby a plurality of glued strips are formed each of which has a first line of glue, a second line of glue and a third line of glue extending along said first, second and third lines, respectively; and (d) setting the glued strips, one against the other such that the central portion of one of the glued strips is adhered by and at the first line of glue thereof to the second longitudinal margin of another of the glued strips that is adjacent said one of the glued strips, the first longitudinal margin of said one of the glued strips is adhered by and at the second glue line thereof to the second longitudinal margin of said another of the glued strips, and the first longitudinal margin of said one of the glued strips is adhered by and at the third line of glue thereof to the central portion of said another of the glued strips.

2. The method according to claim 1, wherein in the step (b) the folding of each of the strips is carried out such that the sum of the widths of the first longitudinal margin and the second longitudinal margin of the folded strip is larger than the width of the central portion of the folded strip.

3. The method according to claim 1, wherein in the step (c) the applying of the glue to each of the folded strips is carried out such that the second line of glue is formed adjacent a free end of the first longitudinal margin of the strip; and in the step (d) the setting of the glued strips one against the other is carried out such that the first longitudinal margin of said one of the glued strips is adhered by and at the second line thereof to a free end of the second longitudinal margin of said another of the glued strips.

4. The method according to claim 1, wherein in the step (c) the applying of the glue to each of the folded strips is carried out such that the first line of glue, the second line of glue and the third line of glue are formed on the same side of the folded strip.

5. The method according to claim 4, wherein in the step (c) the applying of the glue to each of the folded strips is carried out such that the first line of glue is formed along a central portion of the folded strip, and the second glue line and the third glue line are formed along the first and second longitudinal margins of the folded strip, respectively.

6. The method according to claim 1, wherein in the step (c) the applying of the glue to each of the folded strips is carried out such that one of the first, second and third lines of glue is formed on a side of the folded strip different from that on which the other two lines of glue are formed.

7. The method according to claim 1, further comprising a step (d)(1) of bonding the first longitudinal margin to the central portion in each of the folded strips, and bonding the second longitudinal margin to the central portion in each of the folded strips.

8. The method according to claim 1, further comprising a step (c)(1) of applying glue to each of the folded strips along a fourth line extending longitudinally on a respective one of the exposed surfaces at the first side or the second side of the folded strip; a step (d)(1) of bonding the first longitudinal margin of each of the folded strips to the central portion of the folded strip, and wherein in step (d) the setting of the glues strips one against the other is carried out such that the first longitudinal margin of said one of the folded strips is adhered by and at the fourth line of glue thereof to the central portion of said another of the folded strips.

9. A foldable honeycomb structure comprising:

a plurality of folded strips adhered to one another such that each one of the strips is disposed adjacent another of the folded strips;

each of the folded strips having a first longitudinal crease, a second longitudinal crease, a central portion between the first longitudinal crease and the second longitudinal crease, a first longitudinal margin folded towards one side of the central portion along the first longitudinal crease, and a second longitudinal margin folded towards the other side of the central portion along the second longitudinal crease; and wherein the central portion of each said one of the folded strips is adhered by and along a respective first line of glue to the second longitudinal margin of said another of the folded strips adjacent thereto, the first longitudinal margin of each said one of the folded strips is adhered by and along a respective second line of glue to the second longitudinal margin of said another of the folded strips adjacent thereto, and the first longitudinal margin of each said one of the folded strips is adhered by and along a respective third line of glue to the central portion of said another of the folded strips adjacent thereto.

10. The structure according to claim 9, wherein for each of the folded strips the sum of the widths of the first longitudinal margin and the second longitudinal margin thereof is larger than the width of the central portion thereof.

11. The structure according to claim 9, wherein the second line of glue extends adjacent the free end of the first longitudinal margin of said one of the folded strips, and the free end of the first longitudinal margin of said one of the folded strips is adhered by and along the second line of glue to said another of the folded strips adjacent thereto at a location adjacent the free end of the second longitudinal margin said another of the folded strips.

12. The structure according to claim 9, wherein the first line of glue, the second line of glue and the third line of glue are all disposed on the same side of the folded strip for each of the folded strips, respectively.

13. The structure according to claim 9, wherein one of the first the second and the third lines of glue is disposed on a side of each of the folded strips different from that on which the others of the lines of glue are disposed for each of the folded strips, respectively.

14. The structure according to claim 9, wherein the first longitudinal margin of each of the folded strips is bonded to the central portion of the strip along a respective bonding line; and the second longitudinal margin of each of the folded strips is bonded to the central portion of the strip along another respective bonding line.

15. The structure according to claim 9, wherein the first longitudinal margin of each of the folded strips is bonded to the central portion of the strip along a respective bonding line; and the first longitudinal margin of each said one of the folded strips is adhered by and along a another respective line of glue to the central portion of said another of the folded strips adjacent thereto.

16. A method for making a foldable honeycomb structure, comprising the steps of:

(a) providing a plurality of first strips and a plurality of second strips discrete from the first strips;

(b) folding each of the first strips along a respective first line extending the length of the first strip to form a first section and a second section on opposite sides of a first longitudinal crease, the first section and the second section each having a free end remote from the first longitudinal crease;

(c) folding each of the second strips along a respective second line extending the length of the second strip to form a third section and a fourth section on opposite sides of a second longitudinal crease, the third section and the fourth section each having a free end remote from the second longitudinal crease;

(d) for each pair of said first and second strips, connecting the free end of the second section of the first strip of the pair to the free end of the third section of the second strip of the pair, so as to form a plurality of combined strips each of which has the first, second, third and fourth sections and each of which has a first side and a second side facing in opposite directions where outer surfaces of the first, second, third and fourth sections are exposed;

(e) applying glue to each of the combined strips along a first line, a second line and a third line each extending longitudinally on a respective one of the exposed surfaces at the first side or the second side of the combined strip, whereby a plurality of glued strips are formed, each of the glued strips having a first line of glue, a second line of glue and a third line of glue along said first, second and third lines, respectively; and (f) setting the glued strips one against the other such that the third section of one of the glued strips is adhered by and at the first line of glue thereof to the fourth section of of another of the glued strips that is adjacent said one of the glued strips, the first section of said one of the glued strips is adhered by and at the second glue line thereof to the fourth section of said another of the glued strips, and the first section of said one of the glued strips is adhered by and at the third line of glue thereof to the second section of said another of the glued strips.

17. The method according to claim 16, wherein in the step (d) the connecting of the first and second strips of each said pair thereof is carried out such that the sum of the widths of the first section and the fourth section of each of the combined strips is larger than the width of the combined strip as taken between the first and second longitudinal creases thereof.

18. The method according to claim 16, wherein in the step (e) the applying of glue to each of the combined strips is carried out such that the second line of glue is applied to the free end of the first section of the combined strip, and in the step (f) the setting of the combined strips one against the other is carried out such that the free end of the first section of said one of the combined strips is adhered by and along the second line of glue thereof to the free end of the fourth section of said another of the combined strips adjacent thereto.

19. The method according to claim 16, wherein in the step (e) the applying of the glue to each of the combined strips is carried out such that the first line of glue, the second line of glue and the third line of glue are formed on the same side of the combined strip.

20. The method according to claim 19, wherein in the step (e) the applying of the glue to each of the combined strips is carried out such that the first line of glue is applied to the third section of the combined strip, and the second line of glue and the third line of glue are applied to the first section of the combined strip.

21. The method according to claim 16, wherein in the step (e) the applying of the glue to each of the combined strips is carried out such that one of the first, the second and the third lines of glue is applied on a side of the combined strip different from that onto which the other two lines of glue are applied.

22. The method according to claim 16, wherein in the step (d) the connecting of the first and second strips of each said pair thereof is carried out by gluing the free end of the second section to the free end of the third section.

23. The method according to claim 16, wherein in the step (a) the providing of the plurality of first strips and the providing of the plurality of second strips comprises providing a plurality of first strips which have a physical property that is different from that of the second strips.

24. The method according to claim 16, further comprising a step (f)(1) of bonding the first section of each of the combined strips to the second section of the combined strip along a respective bonding line, and bonding the third section of each of the combined strips to the fourth section of the combined strip along another respective bonding line.

25. The method according to claim 16, further comprising a step (e)(1) of applying glue along a fourth line extending longitudinally on the first section of each of the combined strips; and a step (f)(1) of bonding the first section of each of the combined strips to the second section of the combined strip, and wherein in the step (f) the setting of the glued strips one against the other is carried out such that the first section of said one of the combined strips is adhered by and along the fourth line of glue to the second region of said another of the glued strips.

26. A foldable honeycomb structure comprising:

a plurality of combined strips adhered to one another such that each one of the combined strips is disposed adjacent another of the combined strips;

each of the combined strips having first, second, third and fourth sections, a first longitudinal crease about which the first and second sections are folded towards one another, and a second longitudinal crease about which the third and fourth sections are folded towards each other, and each of the combined strips having a first side and a second side facing in opposite directions where outer surfaces of the first, second, third and fourth sections are exposed;

each of the combined strips comprising a first strip having the first longitudinal crease, the first section and the second section such that the first section and the second section each has a free end, and a second strip discrete from the first strip, the second strip having the second longitudinal crease, the third section and the fourth section such that the third section and the fourth section each has a free end, and wherein the free end of the third section is connected to the free end of the second section; and wherein the third section of each said one of the combined strips is adhered by and along a respective first line of glue to the fourth section of said another of the combined strips adjacent thereto, the first section of each said one of the combined strips is adhered by and along a respective second line of glue to the fourth section of said another of the combined strips adjacent thereto, and the first section of each said one of the combined strips is adhered by and along a respective third line of glue to the second section of said another of the combined strips adjacent thereto.

27. The structure according to claim 26, wherein for each of the combined strips the sum of the widths of the first section and the fourth section of the combined strip is larger than the width of the combined strip as taken between the first and second longitudinal creases thereof.

28. The structure according to claim 26, wherein for each of the combined strips the respective second line of glue is disposed adjacent the free end of the first section of the combined strip, and the free end of the first section of each said one of the combined strips is adhered by and along the respective second line of glue to said another of the combined strips at a location adjacent the free end of the fourth section of said another of the combined strips.

29. The structure according to claim 26, wherein the first line of glue, the second line of glue and the third line of glue are all disposed on the same side of the combined strip for each of the combined strips, respectively.

30. The structure according to claim 29, wherein the first line of glue is on the third section of the combined strip, and the second line of glue and the third line of glue are on the first section of the combined strip.

31. The structure according to claim 26, wherein one of the first, the second and the third lines of glue is disposed on a side of the combined strip different from that on which the others of the lines of glue are disposed for each of the combined strips, respectively.

32. The structure according to claim 26, wherein the second section of each of the combined strips is glued to the third section of the combined strip along a line extending adjacent the free ends of the second and the third sections of the combined strip.

33. The structure according to claim 26, wherein the first strip constituting each of the combined strips has a physical property different from that of the second strip constituting the combined strip.

34. The structure according to claim 26, wherein the first section of each of the combined strips is bonded to the second section of the combined strip along a respective bonding line; and the third section of each of the combined strips is bonded to the fourth section of the combined strip along another respective bonding line.

35. The structure according to claim 26, wherein the first section of each of the combined strips is bonded to the second section of the combined strip along a respective bonding line; and the first section of each said one of the combined strips is glued along a respective line to the second section of said another of the combined strips adjacent thereto.

* * * * *